US011298908B2

(12) United States Patent
Nakamura et al.

(10) Patent No.: US 11,298,908 B2
(45) Date of Patent: Apr. 12, 2022

(54) LID FORMING DEVICE

(71) Applicant: ISHIDA CO., LTD., Kyoto (JP)

(72) Inventors: Yuichi Nakamura, Ritto (JP); Tatsuya Iwasa, Ritto (JP); Atsushi Takahashi, Ritto (JP); Satoshi Tatsukawa, Ritto (JP); Satoshi Nishitsuji, Ritto (JP); Tatsuya Arimatsu, Ritto (JP); Koji Ono, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 143 days.

(21) Appl. No.: 16/783,165

(22) Filed: Feb. 6, 2020

(65) Prior Publication Data

US 2020/0254708 A1 Aug. 13, 2020

(30) Foreign Application Priority Data

Feb. 13, 2019 (JP) ..... JP2019-023644
Nov. 5, 2019 (JP) ..... JP2019-200477

(51) Int. Cl.
*B31B 50/26* (2017.01)
*B31B 50/00* (2017.01)

(52) U.S. Cl.
CPC ..... *B31B 50/262* (2017.08); *B31B 50/006* (2017.08)

(58) Field of Classification Search
CPC ... B65B 35/405; B65B 35/205; B65B 43/265; B65B 43/44; B65B 43/305; B65B 43/46; B65B 43/60; B65B 7/24; B65B 2220/18; B65B 5/106; B65B 5/024; B31B 50/004; B31B 50/006; B31B 50/262
See application file for complete search history.

(56) References Cited

U.S. PATENT DOCUMENTS 4,279,377 A * 7/1981 Peeples ..... B65D 5/10 229/157
4,441,303 A * 4/1984 Langen ..... B65B 7/24 52/374

(Continued)

FOREIGN PATENT DOCUMENTS

GB 324830 A 2/1930
JP S58-3881 B2 1/1983

OTHER PUBLICATIONS

The Search Report from the corresponding European Patent Application No. 20156379.8 dated Jul. 14, 2020.

*Primary Examiner* — Thomas M Wittenschlaeger
(74) *Attorney, Agent, or Firm* — Shinjyu Global IP

(57) ABSTRACT

A lid forming device of a cardboard box using a first flap with a slit and a second flap to be extended after being bent into a mountain shape is disclosed. The lid forming device includes first and second folding mechanisms. The fist folding mechanism folds the first flap in a direction of closing the opening. The second folding mechanism bends the second flap into a mountain shape and inserts part of the second flap into the slit of the first flap while extending the second flap. The second folding mechanism includes first and second retaining units. The first retaining unit retains a first face of the second flap located between a free end of the second flap and a bend line set beforehand in the second flap. The second retaining unit retains a second face of the second flap located between an anchored end and the bend line.

12 Claims, 20 Drawing Sheets

(56) References Cited

U.S. PATENT DOCUMENTS

| | | | | | |
|---|---|---|---|---|---|
| 4,584,818 | A * | 4/1986 | Plaskett | B65B 7/24 | 493/136 |
| 4,627,217 | A * | 12/1986 | Plaskett | B65B 7/24 | 493/139 |
| 4,656,810 | A * | 4/1987 | Plaskett | B65B 7/24 | 493/136 |
| 5,066,269 | A * | 11/1991 | Center | B31B 50/00 | 493/183 |
| 5,102,382 | A * | 4/1992 | Center | B31B 50/00 | 493/1 |
| 5,104,035 | A * | 4/1992 | Rosenbaum, II | B65D 5/10 | 229/156 |
| 5,120,293 | A * | 6/1992 | Franklin | B31B 50/00 | 493/125 |
| 5,341,621 | A * | 8/1994 | Martelli | B65B 7/22 | 53/377.5 |
| 10,960,997 | B2 * | 3/2021 | Tatsukawa | B65B 43/10 | |
| 2020/0254707 | A1 * | 8/2020 | Iwasa | B65B 43/44 | |
| 2021/0101354 | A1 * | 4/2021 | Iwasa | B31B 50/734 | |

* cited by examiner

FLAP LENGTH : X+A=190mm

| BOX SPECIFICATIONS | X (mm) | A (mm) | θa (°) | θb (°) |
|---|---|---|---|---|
| TYPE 1 | 70 | 120 | 30.3 | 90 |
| TYPE 2 | 80 | 110 | 36 | 90 |
| TYPE 3 | 95 | 95 | 45 | 90 |

LID FORMING DEVICE

CROSS-REFERENCE TO RELATED APPLICATIONS

This application claims priority to Japanese Applications No. 2019-023644, filed on Feb. 13, 2019, and No. 2019-200477, filed on Nov. 5, 2019. The contents of those applications are incorporated by reference herein in their entirety.

TECHNICAL FIELD

The present invention relates to a lid forming device, and particularly relates to a device that forms lids of cardboard boxes.

BACKGROUND ART

Conventionally, as devices that form lids of cardboard boxes, devices that form slits or the like beforehand in flaps folded first out of a group of flaps provided on edges of an opening of cardboard and thereafter insert into those slits a distal end of a flap folded last are known. For example, Japanese Examined Patent Publication No. S58-3881 discloses an automatic case closer that forms long holes beforehand in first flaps folded first, bends second flaps folded later, then places distal ends of the second flaps along upper surfaces of the first flaps, and pushes in the bent portions so that the distal ends of the second flaps are inserted into the long holes.

BRIEF SUMMARY

However, among cardboard boxes, there are also cardboard boxes that are reutilized, and there are cases where the flaps themselves do not retain their initial hardness and strength. When the second flaps in this state are bent and the bent portions are pushed in, there is the concern that the second flaps will buckle at their distal ends, whose strength is weak, and that the distal ends of the second flaps will not be inserted into the long holes in the first flaps.

It is a problem of the present invention to provide a lid forming device having a configuration with which part of a flap is easily inserted into slits in other flaps of a cardboard box.

A lid forming device pertaining to a first aspect of the invention forms a lid of a cardboard box using, out of a group of flaps provided like cantilevers on edges of an opening of the cardboard box, a first flap in which slit is formed and a second flap that becomes extended after being bent into a mountain shape. The lid forming device has a first folding mechanism and a second folding mechanism. The first folding mechanism folds the first flap in directions in which the first flap closes the opening. The second folding mechanism bends into a mountain shape and then extends the second flap and, in the process of extending the second flap, inserts part of the second flap into the slit in the first flap. The second folding mechanism includes first retaining unit and second retaining unit. The first retaining unit retains a first face between a free end of the second flap and a bend line set beforehand in the second flap. The second retaining unit retains a second face between an anchored end of the second flap and the bend line.

In this lid forming device, the bent portion of the second flap is extended, whereby the distal end of the second flap enters the slit in the first flap, so an unnecessary load is not applied to the second flap, there is also no buckling of the second flap, and the distal end thereof becomes easily inserted into the slit.

A lid forming device pertaining to a second aspect of the invention is the lid forming device pertaining to the first aspect, wherein the second folding mechanism retains the second flap by using the first retaining unit and the second retaining unit to bend the second flap and individually moving the first retaining unit and the second retaining unit until the relative angle between the first face and the second face of the second flap decreases to a predetermined angle.

In this lid forming device, the first face and the second face of the second flap are individually moved, so loads can be applied equally to both faces, and bending defects are reduced.

A lid forming device pertaining to a third aspect of the invention is the lid forming device pertaining to the first aspect or the second aspect, wherein the second folding mechanism places, along upper surfaces of the first flap, a distal end of the second flap that has been bent, at the same time individually moves the first retaining unit and the second retaining unit in directions in which the relative angle between the first face and the second face of the second flap increases, and guides the free end of the second flap to the slit in the first flap.

In this lid forming device, the second folding mechanism places the distal end of the second flap along the upper surfaces of the first flap and at the same time extends the second flap in directions in which the relative angle between the first face and the second face of the second flap increases, so an unnecessary load is not applied to the second flap, and the distal end of the second flap is smoothly inserted into the slit in the first flap without becoming deformed.

A lid forming device pertaining to a fourth aspect of the invention is the lid forming device pertaining to any one of the first aspect to the third aspect, wherein the first retaining unit has a first suction device that sucks hold of the first face. Furthermore, the second retaining unit has a second suction device that sucks hold of the second face.

In this lid forming device, the first retaining unit and the second retaining unit are a suction type, so compared to a case where the second major flap is mechanically caught, concentration of stress in the flap is mitigated, and deformation and the like can be inhibited.

A lid forming device pertaining to a fifth aspect of the invention is the lid forming device pertaining to the fourth aspect, wherein the first retaining unit further has a first cover that surrounds a part of the peripheries of the first suction device. Furthermore, the second retaining unit further has a second cover that surrounds a part of the peripheries of the second suction device.

In this lid forming device, when bending the second flap, the first suction device simply sucks hold of the first face and the second suction device simply sucks hold of the second face, and the first cover fulfills the role of transmitting force to the first face during the bending and the second cover fulfills the role of transmitting force to the second face, so the first suction device and the second suction device are inhibited from sustaining damage due to friction.

A lid forming device pertaining to a sixth aspect of the invention is the lid forming device pertaining to the fourth aspect, wherein the first suction device selectively switches the timing when it releases the first face after it has sucked hold of the first face. Furthermore, the second suction device selectively switches the timing when it releases the second face after it has sucked hold of the second face.

A lid forming device pertaining to a seventh aspect of the invention is the lid forming device pertaining to the first aspect, wherein the second folding mechanism performs a first operation and a second operation. The first operation is an operation in which it inserts into the slit a predetermined portion of the first face of the second flap that has been bent into a mountain shape. The second operation is an operation in which it extends the second flap after the first operation and further inserts toward far sides of the slits the predetermined portion that has been inserted into the slit.

In this lid forming device, even if strain arises in the slit in the first flap due, for example, to reutilization of the cardboard box, the predetermined portion of the first face is reliably inserted further toward the deep sides of the slit as a result of the second flap extending from a state in which the predetermined portion of the first face of the second flap is inserted into the slit.

A lid forming device pertaining to an eighth aspect of the invention is the lid forming device pertaining to the seventh aspect, wherein in the first operation the second folding mechanism forms a first insertion state and thereafter forms a second insertion state. The first insertion state is a state in which a first range of the predetermined portion that is a first dimension away from the free end of the first face is inserted into the slit. The second insertion state is a state in which a second range of the predetermined portion that is a second dimension smaller than the first dimension away from the free end of the first face is inserted into the slit.

In this lid forming device, even in a case where the fill rate of the bags in the cardboard box is high, a space for the second flap to slide into can be ensured by forming the first insertion state in which the second flap is inserted deep into the slit.

A lid forming device pertaining to a ninth aspect of the invention is the lid forming device pertaining to the first aspect, wherein the second folding mechanism further has a drive unit. The drive unit drive the first retaining unit and the second retaining unit until the relative angle between the first face and the second face of the second flap becomes a predetermined angle.

In this lid forming device, when bending the second flap into a mountain shape, the second flap can be bent to an angle suited for inserting the second flap into the slit.

A lid forming device pertaining to a tenth aspect of the invention is the lid forming device pertaining to the ninth aspect, wherein the predetermined angle is set in the range of 90 to 120 degrees.

A lid forming device pertaining to an eleventh aspect of the invention is the lid forming device pertaining to the first aspect, and further has a control unit that controls the second folding mechanism. The second folding mechanism further includes a first drive unit, a second drive unit, a third drive unit, and a measuring unit. The first drive unit causes the second flap to pivot about the anchored end of the second face. The second drive unit performs retention and releases of the first face and the second face of the second flap by means of the first retaining unit and the second retaining unit. The third drive unit drives the first retaining unit and the second retaining unit until the relative angle between the first face and the second face of the second flap becomes a predetermined angle. The measuring unit measures, and outputs to the control unit, at least the operating time of the third drive unit. The control unit adjusts the operation of the first drive unit and/or the operation of the second drive unit on the basis of the operating time of the third drive unit.

In this lid forming device, even when the operation of the third drive unit is unstable and the time until the relative angle between the first face and the second face of the second flap becomes the predetermined angle is not stable, the series of operations of the second folding mechanism becomes stable as a result of the first drive unit and the second drive unit performing operations suited to the operating time of the third drive unit.

A lid forming device pertaining to a twelfth aspect of the invention is the lid forming device pertaining to the eleventh aspect, wherein the first drive unit is a servo motor and the third drive unit is an air cylinders.

A lid forming device pertaining to a thirteenth aspect of the invention is the lid forming device pertaining to the first aspect, and further has a control unit and a detection unit. The control unit controls the second folding mechanism. The detection unit detects, and outputs to the control unit, the height position, from a predetermined reference surface, of the second flap that has been folded by the second folding mechanism. The control unit causes the second folding mechanism to refold the second flap when it has judged that the height position is not in a predetermined range.

In this lid forming device, even if a folding defect occurs, the second folding mechanism automatically retries folding the second flap, so it is not necessary for the operator to stop the device, and a reduction in the operating rate of the device can be inhibited.

In the lid forming device pertaining to the invention, the bent portion of the second flap is extended, whereby the distal end of the second flap enters the slit in the first flap, so an unnecessary load is not applied to the second flap, there is also no buckling of the second flap, and the distal end thereof becomes easily inserted into the slit.

DETAILED DESCRIPTION

Embodiments of the invention will be described below with reference to the drawings. It will be noted that the following embodiments are specific examples of the invention and are not intended to limit the technical scope of the invention.

First Embodiment

(1) Configuration of Box Packing System 1

Figure 1:
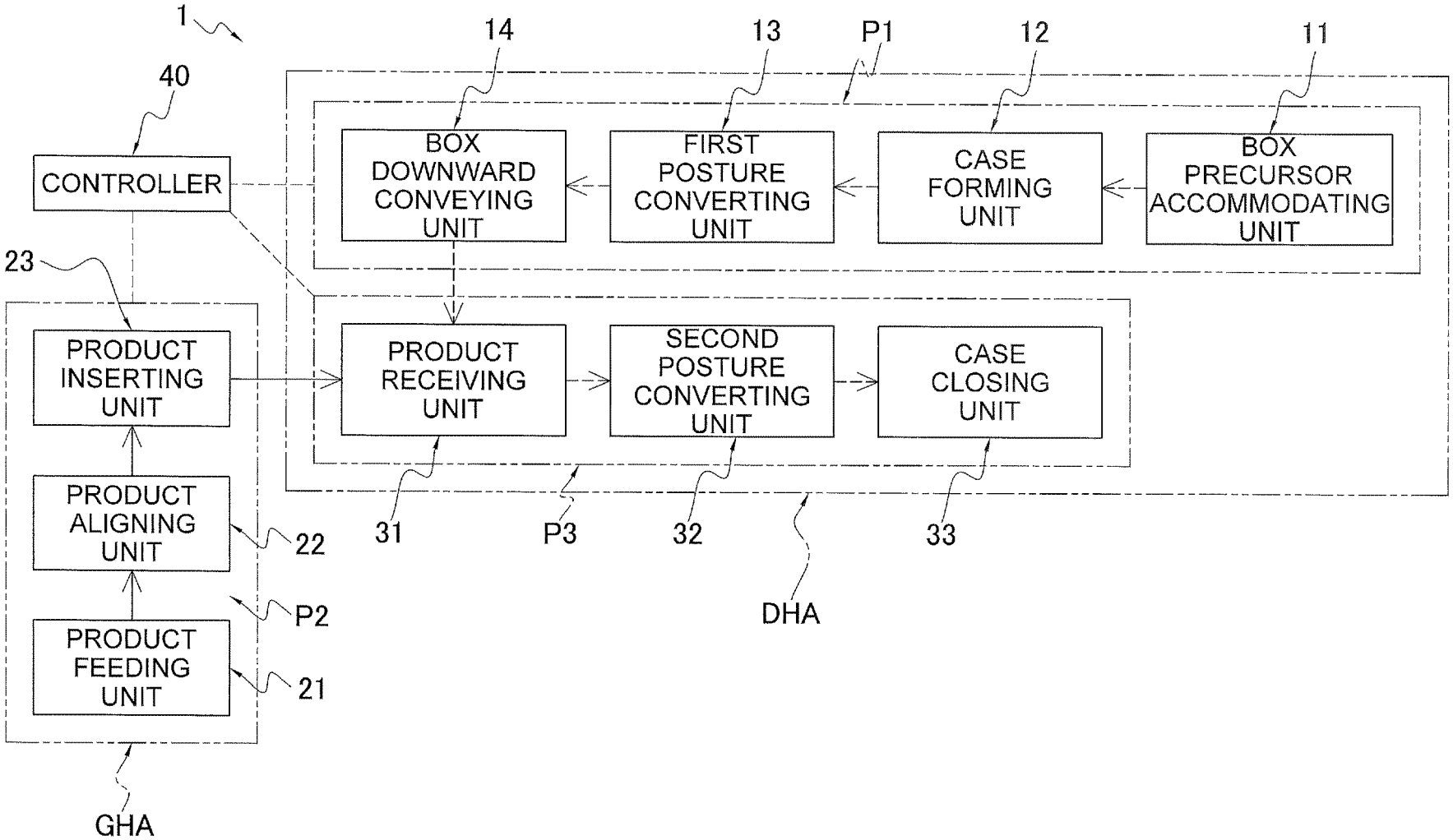
FIG. 1 is a block diagram of a box packing system equipped with a lid forming device pertaining to a first embodiment of the invention.

FIG. 1 is a block diagram of a box packing system 1 equipped with a cardboard box erector pertaining to a first embodiment of the invention. Furthermore, FIG. 2A is a perspective view showing the configuration of the box packing system 1, and FIG. 2B is a perspective view showing a flow of cardboard boxes B and products G in the box packing system 1.

Figure 2A:
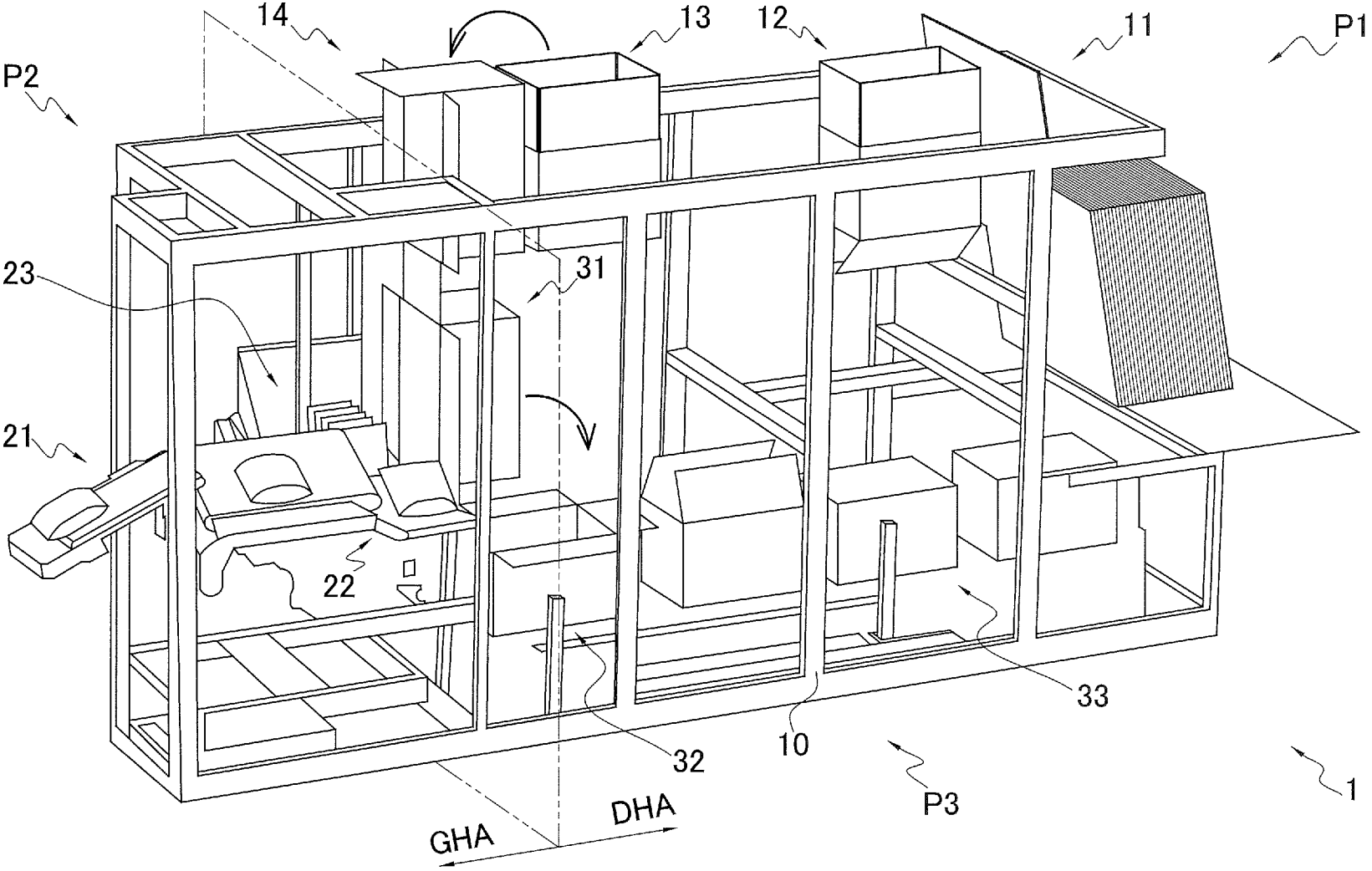
FIG. 2A is a perspective view showing the configuration of the box packing system.
Figure 2B:
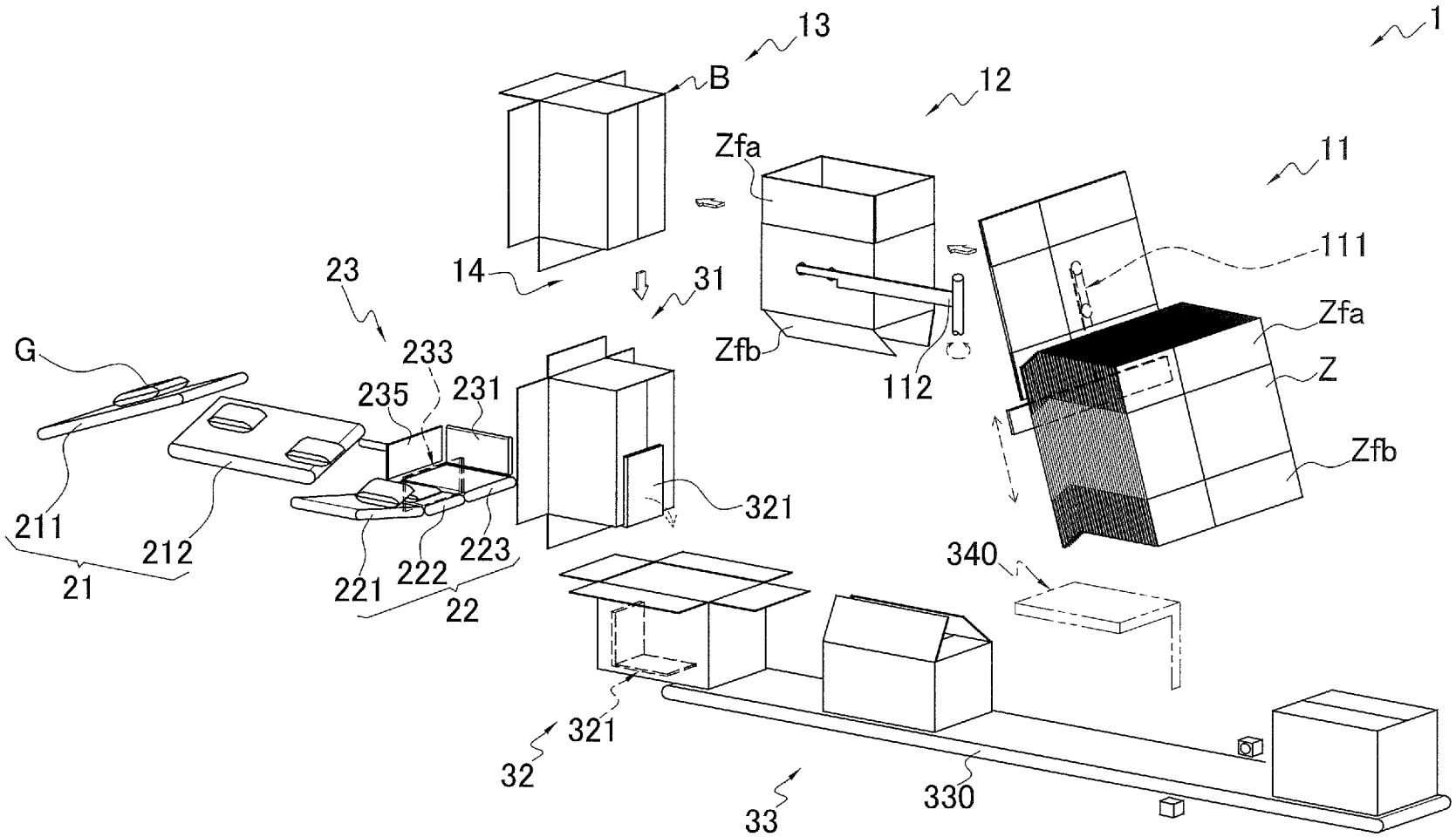
FIG. 2B is a perspective view showing a flow of cardboard boxes and products in the box packing system.

In FIG. 1 and FIG. 2A, the box packing system 1 packs a fixed number of bagged products (products G), such as snack foods for example, in an aligned state and in multiple layers into cardboard boxes B.

As shown in FIG. 1 and FIG. 2A, the box packing system 1 comprises a cardboard box handling area DHA and a product handling area GHA that are interconnected in a state in which they are mutually independently separable. The cardboard box handling area DHA includes two processes, a case forming process P1 and a box packing process P3. The product handling area GHA includes a product aligning process P2.

That is, in the box packing system 1, the three processes of the case forming process P1, the product aligning process P2, and the box packing process P3 work together as a result of the cardboard box handling area DHA and the product handling area GHA being interconnected.

The case forming process P1 is a process of erecting sheet-like cardboard box precursors Z into cardboard boxes B and conveying the cardboard boxes B to a box packing position. The case forming process P1 is configured by a box precursor accommodating unit 11, a case forming unit 12, a first posture converting unit 13, and a box downward conveying unit 14.

The product aligning process P2 is a process of feeding to a predetermined position the products G that are supplied from an upstream process, aligning a fixed number of the products G so that adjacent products partially lie on top of each other, and conveying the fixed number of products G to the box packing position. The product aligning process P2 is configured by a product feeding unit 21, a product aligning unit 22, and a product inserting unit 23.

The box packing process P3 is a process of packing, into the cardboard boxes B that have been conveyed thereto from the case forming process P1, the fixed quantity of the products G that have finished being aligned in the product aligning process P2, closing the boxes, and conveying the boxes to a box discharge position. The box packing process P3 is configured by a product receiving unit 31, a second posture converting unit 32, and a case closing unit 33.

The box packing system 1 performs multilayer packing of the products G into the cardboard boxes B, and the posture of the products G inside the cardboard boxes B is a "standing posture." That is, the standing posture is a posture where, when the openings of the cardboard boxes B face up, the front sides and the back sides of the products G face sideways, the upper and lower end portions of the products G face up and down, and the left and right side portions of the products G face sideways.

Furthermore, as shown in FIG. 2A and FIG. 2B, the cardboard box handling area DHA has a two-level structure, and the case forming process P1 and the box packing process P3 are supported by a common frame 10. The case forming process P1 occupies the second-level portion, and the box packing process P3 occupies the first-level portion.

In order to realize this two-level structure, the conveyance direction of the cardboard boxes B from the erection of the cardboard boxes B by the case forming unit 12 to the box downward conveying unit 14 and the conveyance direction of the cardboard boxes B up to when the openings of the cardboard boxes B that have been packed with the products G are closed by the case closing unit 33 are mutually opposite directions.

(2) Case Forming Process P1

As shown in FIG. 2B, the case forming process P1 is configured by the box precursor accommodating unit 11 that introduces the cardboard box precursors Z to the box packing system 1, the case forming unit 12 that erects the cardboard boxes B, the first posture converting unit 13 that rotates the cardboard boxes B 90° about a horizontal axis orthogonal to the conveyance direction, and the box downward conveying unit 14 that conveys downward the cardboard boxes B that have been converted to a first posture.

(2-1) Box Precursor Accommodating Unit 11

As shown in FIG. 2B, the box precursor accommodating unit 11 takes hold of one at a time and transports upward the cardboard box precursor Z at the very front of the cardboard box precursors Z stacked in a supply position and rotates the transported cardboard box precursor Z 90° about a vertical axis to thereby open it into a tubular shape.

The cardboard box precursors Z are placed in the supply position by a worker. The cardboard box precursors Z are collapsed with their flaps Zf open and are stacked in a horizontal direction in a posture in which the flaps Zf are positioned in the vertical direction. It will be noted that for convenience of description the flaps Zf on the top surface side will be called top flaps Zfa and the flaps Zf on the bottom surface side will be called bottom flaps Zfb.

The upward transport of the cardboard box precursors Z is performed by a lift mechanism 111. When all the cardboard box precursors Z in the supply position run out, a detection sensor (not shown in the drawings) sends a detection signal to a controller 40 (see FIG. 1).

Furthermore, the rotation of the cardboard box precursors Z about the vertical axis is realized by sucking and holding, with suction cups, the side surfaces of the cardboard box precursors Z with a sucking and rotating mechanism 112 and rotating the sucking and rotating mechanism 112 90° about the vertical axis.

(2-2) Case Forming Unit 12

The case forming unit 12 conveys in a horizontal direction the cardboard box precursors Z that have been opened into a tubular shape and at the same time folds the bottom flaps Zfb of the cardboard box precursors Z to form bottoms, thereby erecting the cardboard boxes B which are in a state in which their top flaps Zfa are open.

(2-3) First Posture Converting Unit 13

The first posture converting unit 13 rotates the cardboard boxes B 90° in the conveyance direction. More specifically, the first posture converting unit 13 rotates the cardboard boxes B 90° about a horizontal axis orthogonal to the conveyance direction to thereby convert the posture of the cardboard boxes B to a posture (hereinafter called a first posture) in which the openings and the top flaps Zfa of the cardboard boxes B lie in the same vertical plane. When the cardboard boxes B are in the first posture, their openings face the product handling area GHA.

(2-4) Box Downward Conveying Unit 14

The box downward conveying unit 14 conveys downward the cardboard boxes B that have been converted to the first posture. That is, the box downward conveying unit 14 moves the cardboard boxes B downward while keeping the openings of the cardboard boxes B facing the product handling area GHA.

(3) Product Aligning Process P2

Disposed upstream of the product aligning process P2 in the flow of the products G in the box packing system 1 are a weigher and a bag-making and packaging machine not shown in the drawings. Only products G that have passed weight, seal, and contamination inspections in the upstream process are supplied to the product aligning process P2 in the box packing system 1.

The product aligning process P2 is configured by the product feeding unit 21 that accepts the products G and conveys them to a predetermined position, the product aligning unit 22 that aligns the products G that are supplied from the product feeding unit 21, and the product inserting unit 23 that accumulates and pushes the aligned products G.

(3-1) Product Feeding Unit 21

The product feeding unit 21 has a product introducing conveyor 211 and a feeding conveyor 212. The product introducing conveyor 211 receives, downstream of the process that performs the weight, seal, and contamination inspections, the supply of the products G that have passed the inspections and leads those products G to the feeding conveyor 212.

The feeding conveyor 212 conveys to the product aligning unit 22 the products G conveyed thereto from the product introducing conveyor 211.

(3-2) Product Aligning Unit 22

The product aligning unit 22 has a first aligning conveyor 221, a second aligning conveyor 222, and a third aligning conveyor 223. The product aligning unit 22 conveys the products G to a predetermined position while performing an accumulating operation with respect to the products G. The product aligning unit 22 is particularly suited for accumulating bag-like packages, so it can also be used independently as a package accumulating device.

(3-3) Product Inserting Unit 23

The product inserting unit 23 sandwiches the front and rear of the group of products G that have been aligned in a line by the third aligning conveyor 223 and inserts the whole group of products G into the cardboard boxes B. As shown in FIG. 2B, the product inserting unit 23 has a stand-up conveyor 231, a push plate 233, and an insertion plate 235 in order to sandwich the aligned group of products G.

(4) Box Packing Process P3

The box packing process P3 has the product receiving unit 31 that receives the products G into the cardboard boxes B, the second posture converting unit 32 that converts the posture of the cardboard boxes B so that the openings of the cardboard boxes B face up, and the case closing unit 33 that conveys the cardboard boxes B that have finished being packed with the products G and at the same time closes the openings of the cardboard boxes B.

(4-1) Product Receiving Unit 31

The product receiving unit 31 maintains the cardboard boxes B in the first posture and has the cardboard boxes B stand by with their openings opposing the insertion plate 235 of the product inserting unit 23. An N-number of the products G that have been converted to the standing state in the product inserting unit 23 are pushed by the insertion plate 235 toward the open surfaces of the cardboard boxes B, so the product receiving unit 31 stands by in that position until the N-number of the products G are completely inserted through the openings to the bottoms of the cardboard boxes B.

When a first layer of the N-number of the products G is inserted into a cardboard box B, the product receiving unit 31 descends a predetermined distance. Then, in order to receive a second layer of the N-number of the products G, the product receiving unit 31 has the cardboard box B stand by in such a way that the portion of the opening of the cardboard box B that leads to the space above the first layer opposes the insertion plate 235.

The product receiving unit 31 repeats the above operations so that an i-th layer of the N-number of the products G is inserted into the cardboard box B, and then the receiving of the products G into the cardboard box B is finished.

(4-2) Second Posture Converting Unit 32

As shown in FIG. 2B, the second posture converting unit 32 has a posture converting mechanism 321 that converts the posture of the cardboard boxes B packed with the products G to a posture in which the openings face up.

The posture converting mechanism 321 rotates the cardboard boxes B so that the open surfaces that had been vertical until then become horizontal, namely, so that the open surfaces face up. The posture converting mechanism 321 retains the cardboard boxes B with an L-shaped member having suction cups that simultaneously suck hold of the side surfaces and the bottom surfaces of the cardboard boxes B, and when the L-shaped member rotates 90°, the cardboard boxes B rotate.

(4-3) Case Closing Unit 33

As shown in FIG. 2B, the case closing unit 33 has a discharge conveyor 330 that conveys the cardboard boxes B and a lid forming device 340 that closes the flaps surrounding the openings of the cardboard boxes B to thereby form lids.

Below, details regarding the lid forming device 340 will be described.

(5) Lid Forming Device 340

Here, the operation of folding the top flaps Zfa of the cardboard box B will be mainly described.

(5-1) Top Flaps Zfa of Cardboard Box B

Figure 3A:
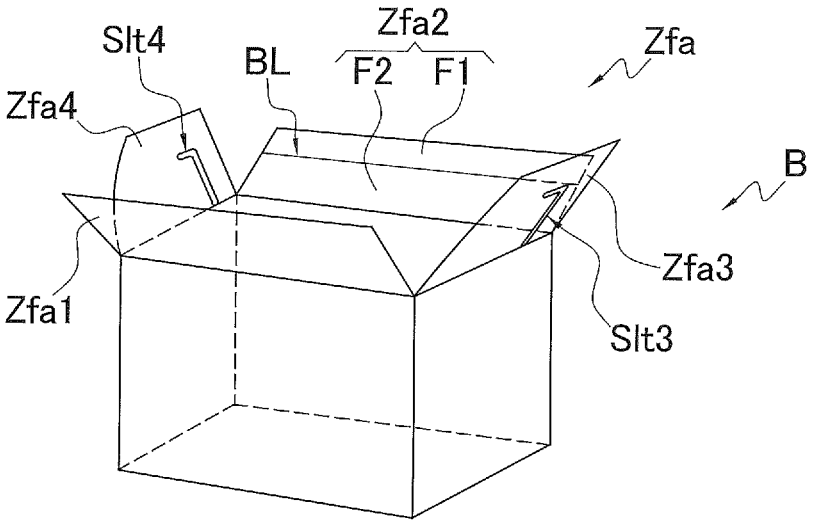
FIG. 3A is perspective view of a cardboard box before top flaps are folded.

First, before the operation is described, the cardboard box B handled by the box packing system 1 will be described. FIG. 3A is a perspective view of the cardboard box B before the top flaps Zfa are folded. Furthermore, FIG. 3B is a perspective view showing, in three stages, a process of folding the top flaps Zfa in FIG. 3A.

Figure 3B:
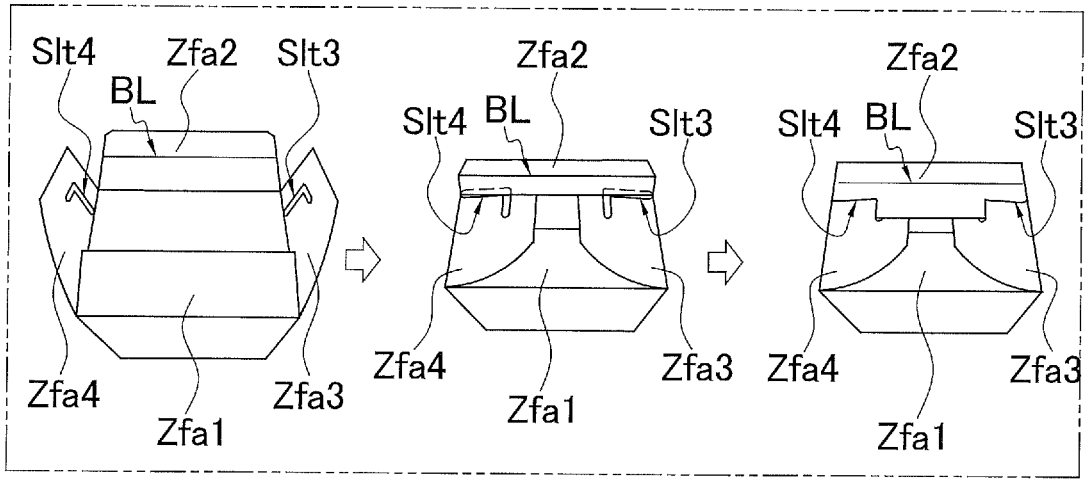
FIG. 3B is a perspective view showing, in three stages, a process of folding the top flaps in FIG. 3A.

In FIG. 3A and FIG. 3B, the top flaps Zfa include a first major flap Zfa1 and a second major flap Zfa2, which are a pair of major flaps that are opposite each other, and a first minor flap Zfa3 and a second minor flap Zfa4, which are a pair of minor flaps that are opposite each other.

The second major flap Zfa2 is provided beforehand with a bend line BL in a portion which, when the second major flap Zfa2 has been folded into a mountain shape, becomes the top of the mountain. The face of the second major flap Zfa2 on the free end side of the bend line BL will be called a first face F1, and the face on the anchored end side of the bend line BL will be called a second face F2.

In the first minor flap Zfa3 and the second minor flap Zfa4 are formed slits into which the second major flap Zfa2 is inserted. The slit in the first minor flap Zfa3 is a slit Slt3, and the slit in the second minor flap Zfa4 is a slit Zlt4.

The slits Slt3 and Slt4 are L-shaped and each have first slit portions, which face free end sides of the flaps and are parallel to those free ends, and second slit portions, which face the side ends of the flaps on the second major flap Zfa2 side and are parallel to those side ends.

FIG. 3B shows the folding order of the top flaps Zfa. First, the first major flap Zfa1 is folded, then the first minor flap Zfa3 and the second minor flap Zfa4 are folded, and lastly the second major flap Zfb2 is folded.

When folding the second major flap Zfa2, the second major flap Zfa2 is bent into a mountain shape so that the bend line BL forms the top, the distal end of the second major flap Zfa2 is inserted into the second slit portions of the slits Slt3 and Slt4, and then the second major flap Zfa2 is extended, whereby the second major flap Zfa2 slides through the slits Slt3 and Slt4 and under the first major flap Zfa1, and the lid is finished. Because of this, the four top flaps Zfa interfere with each other and become locked.

The lid forming device 340 performs the folding of the top flaps Zfa automatically. Below, the operation of folding the top flaps Zfa will be described.

(5-2) Configuration of Lid Forming Device 340

Figure 4:
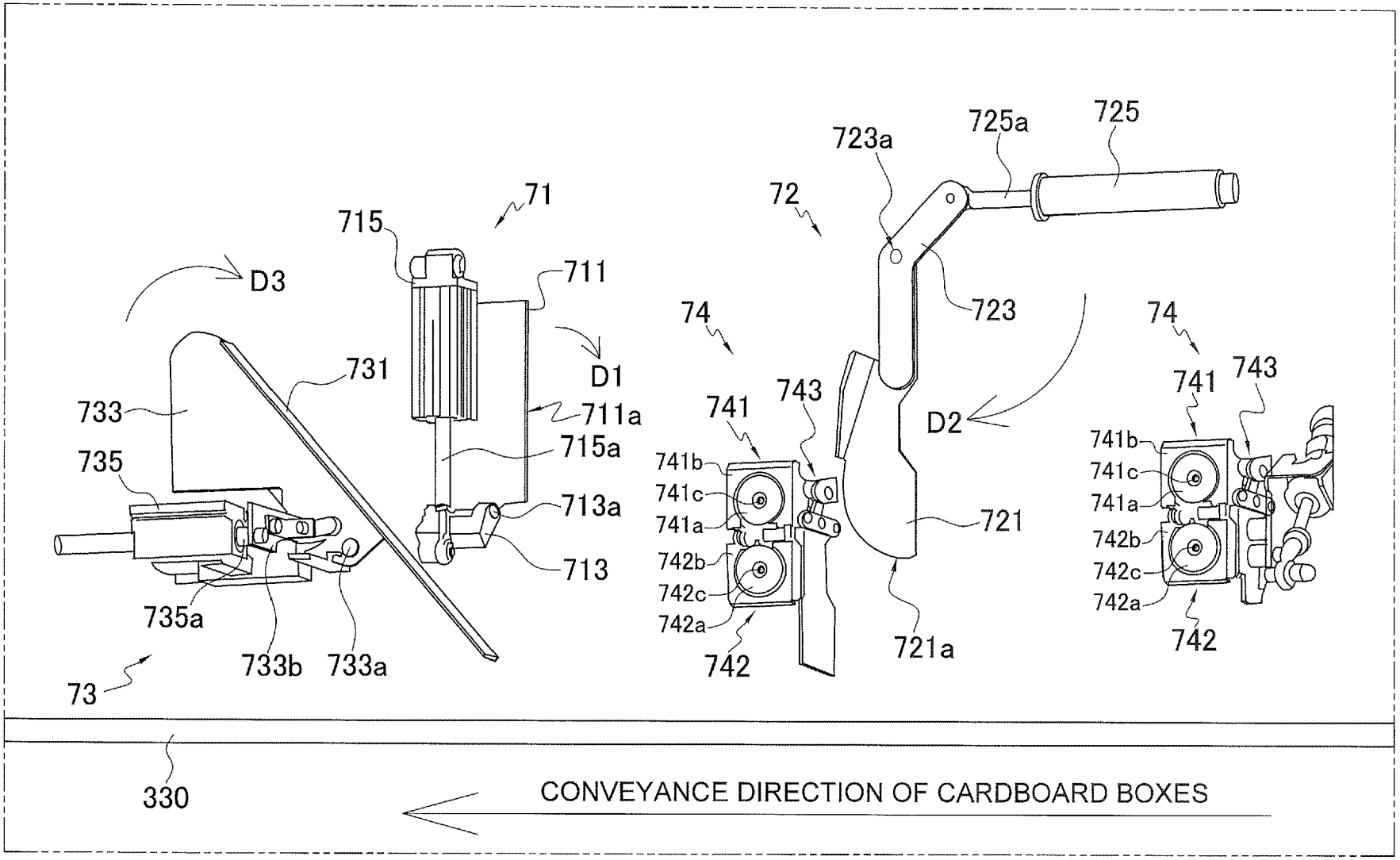
FIG. 4 is a perspective view of main portions of the lid forming device.

FIG. 4 is a perspective view of main portions of the lid forming device 340. In FIG. 4, the lid forming device 340 includes a first major flap folding mechanism 71, a first minor flap folding mechanism 72, a second minor flap folding mechanism 73, and a second major flap folding mechanism 74.

The mechanisms are arranged in such a way that, heading in the conveyance direction of the cardboard boxes B, the first major flap folding mechanism 71 is disposed on the left side of the discharge conveyor 330 and the second major flap folding mechanism 74 is disposed on the right side of the discharge conveyor 330. Furthermore, the first minor flap folding mechanism 72 is disposed upstream in the conveyance direction of the cardboard boxes B, and the second minor flap folding mechanism 73 is disposed downstream in the conveyance direction of the cardboard boxes B.

Below, these mechanisms will be described in the order in which they operate.

(5-2-1) First Major Flap Folding Mechanism 71

The first major flap folding mechanism 71 is a mechanism that folds the first major flap Zfa1 and includes a first folding plate 711, a first coupling member 713, and a first air cylinder 715.

(5-2-1-1) First Folding Plate 711

The first folding plate 711 is a plate metal member that has a restraining surface 711*a* that is a flat rectangular surface. The first folding plate 711 is a plate for folding the first major flap Zfa1.

(5-2-1-2) First Coupling Member 713 and First Air Cylinder 715

The first coupling member 713 is a member that transmits displacement of a piston of the first air cylinder 715 to the first folding plate 711.

One end of the first coupling member 713 is coupled to one end of the first folding plate 711. The first coupling member 713 has a rotational shaft 713*a*. The rotational shaft 713*a* is provided in the neighborhood of the portion coupled to the first folding plate 711.

(5-2-1-3) Operation

The other end of the first coupling member 713 is connected to a distal end of a piston 715*a* of the first air cylinder 715. When the piston 715*a* reciprocates, the first coupling member 713 pivots about the rotational shaft 713*a*, so the first folding plate 711 swings in accompaniment therewith.

The first folding plate 711 shown in FIG. 4 is in a standby state before it folds the first major flap Zfa1. When the first air cylinder 715 retracts the piston 715*a*, the first coupling member 713 pivots in the direction of arrow D1 together with the first folding plate 711, and the first folding plate 711 folds the first major flap Zfa1.

(5-2-2) First Minor Flap Folding Mechanism 72

The first minor flap folding mechanism 72 includes a second folding plate 721, a second coupling member 723, and a second air cylinder 725.

(5-2-2-1) Second Folding Plate 721

The second folding plate 721 is a plate metal member that has a quarter arc 721*a*. The portion of the second folding plate 721 connected to the second coupling member 723 is provided in a position a predetermined distance away from the quarter arc 721*a*. The second folding plate 721 is a plate for folding the first minor flap Zfa3.

(5-2-2-2) Second Coupling Member 723 and Second Air Cylinder 725

The second coupling member 723 is a member that transmits displacement of a piston of the second air cylinder 725 to the second folding plate 721.

One end of the second coupling member 723 is coupled to a connecting portion provided on one end side of the second folding plate 721. The second coupling member 723 has a rotational shaft 723*a*. The rotational shaft 723*a* is provided in the neighborhood of the middle portion of the second coupling member 723.

(5-2-2-3) Operation

The other end of the second coupling member 723 is connected to a distal end of a piston 725*a* of the second air cylinder 725. When the piston 725*a* reciprocates, the second coupling member 723 pivots about the rotational shaft 723*a*, so the second folding plate 721 swings in accompaniment therewith.

Before the folding operation, the second folding plate 721 stands by in a position in which its distal end faces the horizontal direction. The second folding plate 721 shown in FIG. 4 is depicted in a position to which it has pivoted in the direction of arrow D2 so that the quarter arc 721*a* has folded the first minor flap Zfa3.

(5-2-3) Second Minor Flap Folding Mechanism 73

The second minor flap folding mechanism 73 includes a third folding plate 731, a third coupling member 733, and a third air cylinder 735.

(5-2-3-1) Third Folding Plate 731

The third folding plate 731 is a strip-like plate metal member. The third folding plate 731 is a plate for folding the second minor flap Zfa4.

(5-2-3-2) Third Coupling Member 733 and Third Air Cylinder 735

The third coupling member 733 is a member that transmits displacement of a piston of the third air cylinder 735. The third coupling member 733 is a plate-shaped plate metal member, and one end face thereof is welded to the back face of the third folding plate 731. Therefore, the principal plane of the third coupling member 733 and the principal plane of the third folding plate 731 are perpendicular to each other. It will be noted that what is meant by "the back face of the third folding plate 731" is the face on the opposite side when the face that comes into contact with the second minor flap Zfa4 is taken to be the outer surface.

The third coupling member 733 has a rotational shaft 733*a*. The rotational shaft 733*a* is provided in the end portion of the third coupling member 733. A connecting member 733*b* for connecting a piston 735*a* of the third air cylinder 735 is coupled to the third coupling member 733 in the neighborhood of the rotational shaft 733*a*.

(5-2-3-3) Operation

When the piston 735*a* reciprocates, the third coupling member 733 pivots about the rotational shaft 733*a*, so the third folding plate 731 swings in accompaniment therewith.

The third folding plate 731 shown in FIG. 4 is in a standby state before it folds the second minor flap Zfa4. When the third air cylinder 735 extends the piston 735*a*, the third coupling member 733 pivots in the direction of arrow D3 together with the third folding plate 731, and the third folding plate 731 folds the second minor flap Zfa4.

(5-2-4) Second Major Flap Folding Mechanism 74

Figure 5:
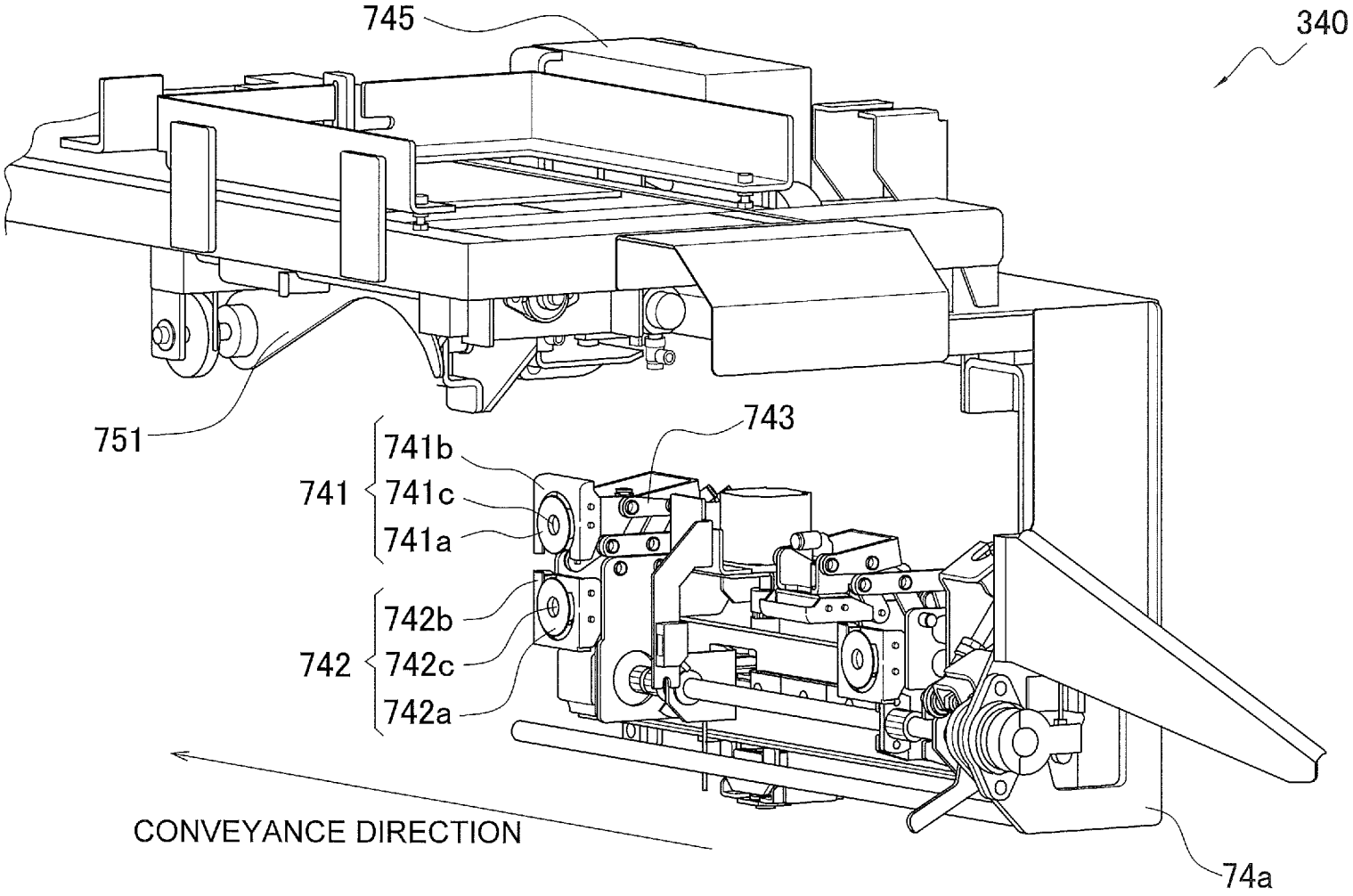
FIG. 5 is a perspective view of a second major flap folding mechanism.

FIG. 5 is a perspective view of the second major flap folding mechanism 74. In FIG. 5, the second major flap folding mechanism 74 is a mechanism that folds the second major flap Zfa2 and includes first face retaining units 741, second face retaining units 742, parallel cranks 743, crank air cylinders 744 (see FIG. 6), and a drive motor 745.

(5-2-4-1) First Face Retaining Units 741

The first face retaining units 741 retain the first face F1 of the second major flap Zfa2 (see FIG. 3A). As shown in FIG. 3A, the first face F1 is the face of the second major flap Zfa2 on the free end side of the bend line BL.

The first face retaining units 741 each include a first suction cup 741*a* and a first cover 741*b*. The first suction cup 741*a* has a circular suction surface in the middle of which is formed a hole 741*c* for suction. The hole 741*c* is connected to a suction tube (not shown in the drawings). The first cover 741*b* is a member that surrounds the periphery of the first suction cup 741*a*.

(5-2-4-2) Second Face Retaining Units 742

The second face retaining units 742 retain the second face F2 of the second major flap Zfa2 (see FIG. 3). As shown in FIG. 3A, the second face F2 is the face of the second major flap Zfa2 on the anchored end side of the bend line BL.

The second face retaining units 742 each include a second suction cup 742*a* and a second cover 742*b*. The second suction cup 742*a* has a circular suction surface in the middle of which is formed a hole 742*c* for suction. The hole 742*c* is connected to a suction tube (not shown in the drawings). The second cover 742*b* is a member that surrounds the periphery of the second suction cup 742*a*.

It will be noted that, as shown in FIG. 4 and FIG. 5, one set each of the first face retaining unit 741 and the second face retaining unit 742 is disposed upstream and downstream along the conveyance direction. The first face retaining units 741 and the second face retaining units 742 in a standby state are lined up so that the second face retaining units 742 are positioned under the first face retaining units 741, and the suction surfaces of the first suction cups 741*a* and the second suction cups 742*a* are positioned in the same vertical plane.

It will be noted that when bending the second major flap Zfa2, the first suction cups 741*a* simply suck the first face F1 and the second suction cups 742*a* simply suck the second face F2, whereby the first covers 741*b* fulfill the role of transmitting force to the first face F1 during bending and the second covers 742*b* fulfill the role of transmitting force to the second face F2.

(5-2-4-3) Parallel Cranks 743 and Crank Air Cylinders 744

Figure 6:
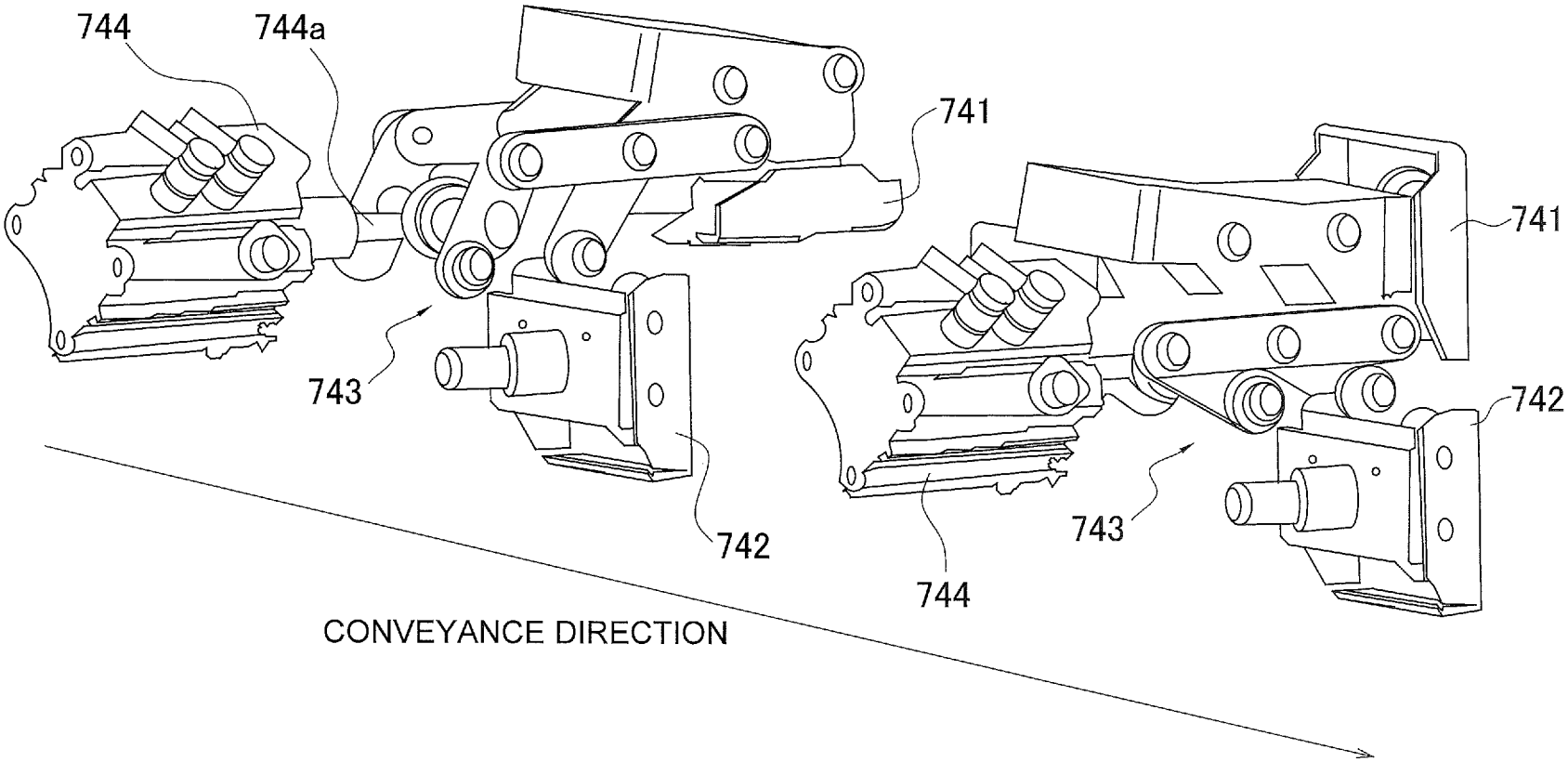
FIG. 6 is a perspective view of first face retaining units and second face retaining units when they are seen from their back sides.

FIG. 6 is a perspective view of the first face retaining units 741 and the second face retaining units 742 when they are seen from their back sides. In FIG. 6, the parallel cranks 743 are disposed on the back sides of the first face retaining units 741. The parallel cranks 743 cause, by means of the reciprocating operation of pistons 744*a* of the crank air cylinders 744, the first face retaining units 741 to pivot so that the first face retaining units 741 incline a predetermined angle with respect to the second face retaining units 742.

In the present embodiment, by extending the pistons 744*a*, the parallel cranks 743 cause the first face retaining units 741 to pivot so that the first face retaining units 741 form a 90° angle with respect to the second face retaining units 742.

It will be noted that during actual operation the first face retaining units 741 located upstream and downstream in the conveyance direction pivot synchronously, but in FIG. 5 and FIG. 6 the first face retaining unit 741 located downstream is depicted in a posture before pivoting and the first face retaining unit 741 located upstream is depicted in a posture after pivoting in order to express the difference in posture before and after pivoting.

(5-2-4-4) Drive Motor 745

As shown in FIG. 5, the drive motor 745 is disposed on the downstream upper side of the lid forming device 340. The drive motor 745 is connected by a link mechanism 74*b* (see FIG. 7D) to a frame 74*a* that supports the first face retaining units 741 and the second face retaining units 742, and when the drive motor 745 rotates, the frame 74*a* pivots, so the first face retaining units 741 and the second face retaining units 742 integrally pivot.

(6) Operations of Second Major Flap Folding Mechanism 74

The second major flap folding mechanism 74 folds the second major flap Zfa2 after the first major flap Zfa1 has been folded by the first major flap folding mechanism 71, the first minor flap Zfa3 has been folded by the first minor flap folding mechanism 72, and the second minor flap Zfa4 has been folded by the second minor flap folding mechanism 73.

FIG. 7A to FIG. 7D are views showing operations by which the second major flap Zfa2 is folded by the first face retaining units 741 and the second face retaining units 742. Below, the operations performed by the second major flap folding mechanism 74 will be described with reference to these drawings.

(6-1) Suction Operation

Figure 7A:
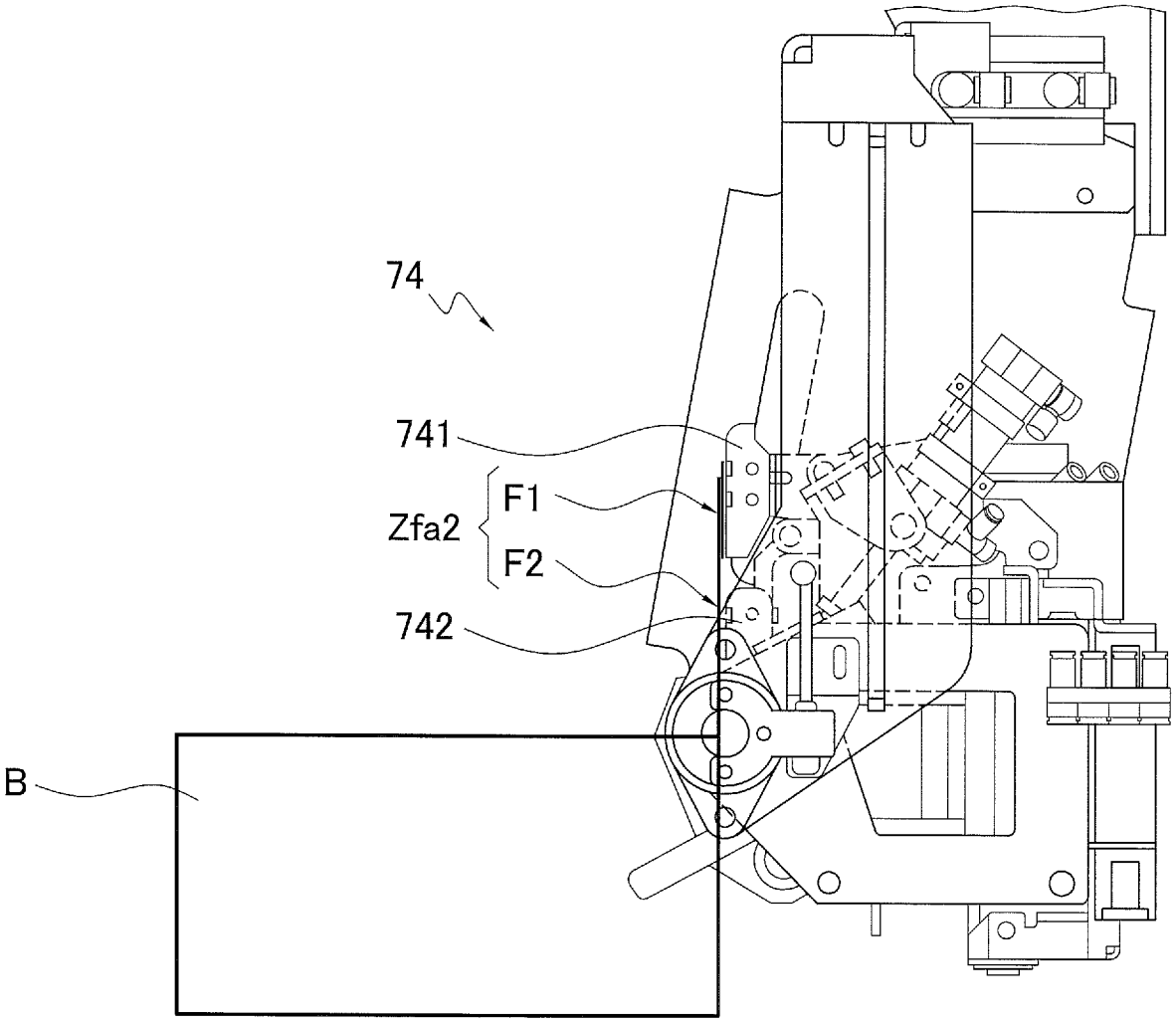
FIG. 7A is a side view of the second major flap folding mechanism when the first face retaining units and the second face retaining units have sucked hold of a second major flap before folding it.

First, FIG. 7A is a side view of the second major flap folding mechanism 74 when the first face retaining units 741 and the second face retaining units 742 have sucked hold of the second major flap Zfa2 before folding it. In FIG. 7A, the first face retaining units 741 and the second face retaining units 742 are lined up so that the second face retaining units 742 are positioned under the first face retaining units 741, and the suction surfaces of the first suction cups 741*a* and the second suction cups 742*a* are positioned in the same vertical plane. The relative angle between the first face retaining units 741 and the second face retaining units 742 at this time is 180°.

The second major flap Zfa2 of the cardboard box B that has reached the front of the first face retaining units 741 and the second face retaining units 742 is pulled close to the first face retaining units 741 and the second face retaining units 742 by another mechanism not shown in the drawings.

The first suction cups 741*a* and the second suction cups 742*a* suck hold of the outer surface of the second major flap Zfa2 that has come in front of them because they are sucking. At this time, the first suction cups 741*a* suck hold of the first face F1, and the second suction cups 742*a* suck hold of the second face F2.

(6-2) Folding Operation

Figure 7B:
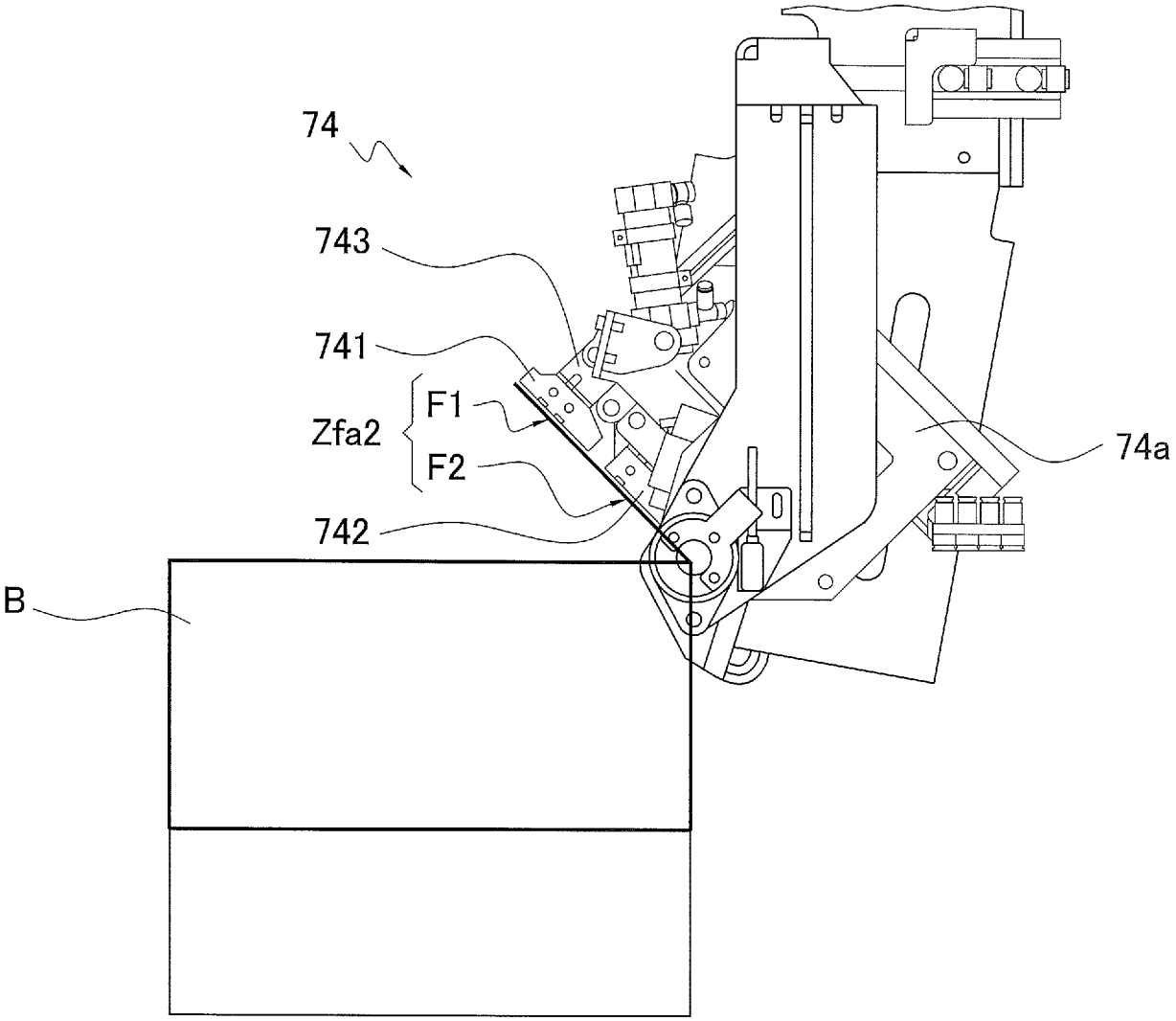
FIG. 7B is a side view of the second major flap folding mechanism when the first face retaining units and the second face retaining units are sucking hold of the second major flap and have started folding it.

Next, FIG. 7B is a side view of the second major flap folding mechanism 74 when the first face retaining units 741 and the second face retaining units 742 are sucking hold of the second major flap Zfa2 and have started folding it.

In FIG. 7B, the first face retaining units 741 and the second face retaining units 742 incline in the direction of the inside of the cardboard box B while continuing to suck hold of the outer surface of the second major flap Zfa2. Specifically, the frame 74*a* that anchors the first face retaining units 741 and the second face retaining units 742 is pivoted a predetermined angle θa by the drive motor 745, whereby the first face retaining units 741 and the second face retaining units 742 integrally incline the predetermined angle θa in the direction of the inside of the cardboard box B.

Figure 9:
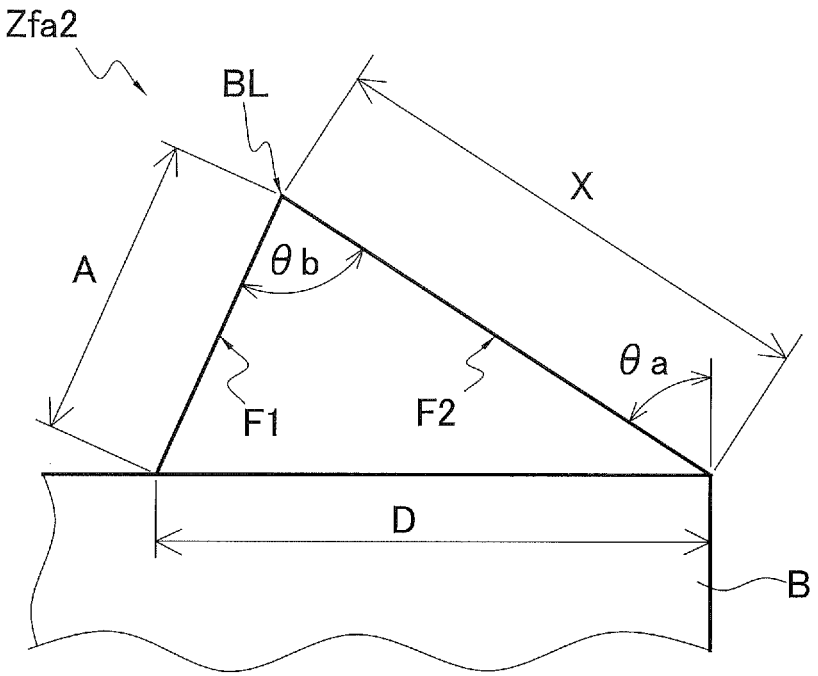
FIG. 9 is a table showing the relationship between the length of a first face, the length of a second face, and a predetermined angle.

It will be noted that the predetermined angle θa differs depending on the box specifications of the cardboard box B. For example, FIG. 9 is a table showing the relationship between a length A of the first face F1, a length X of the second face F2, and the predetermined angle θa. In FIG. 9, the illustration above the table shows the side faces of the first face F1 and the second face F2 after the second major flap Zfa2 has been mountain-folded at the bend line BL.

Furthermore, also regarding the box specifications of the cardboard box B, those shown in FIG. 9 are by no means exhaustive, and 190 mm is shown only as an example of the length of the second major flap Zfa2.

As shown in FIG. 9, when the combination of the length A of the first face F1 and the length X of the second face F2 differs, the predetermined angle θa also changes in accompaniment therewith.

This is because the second major flap Zfa2 becomes bent along the bend line BL by a mountain-folding operation described next, so when the position of the bend line BL changes, the combination of the length A of the first face F1 and the length X of the second face F2 becomes different, so it is necessary to also change the predetermined angle θa to make an adjustment so that the distal end of the first face F1 after being bent reaches an appropriate landing point.

In order for the landing point of the distal end of the first face F1 after being bent to be in a position a distance D from the base of the second major flap Zfa2, a bend angle θb is calculated from the length A of the first face F1, the length X of the second face F2, the predetermined angle θa, and the distance D.

(6-3) Mountain-Folding Operation

Figure 7C:
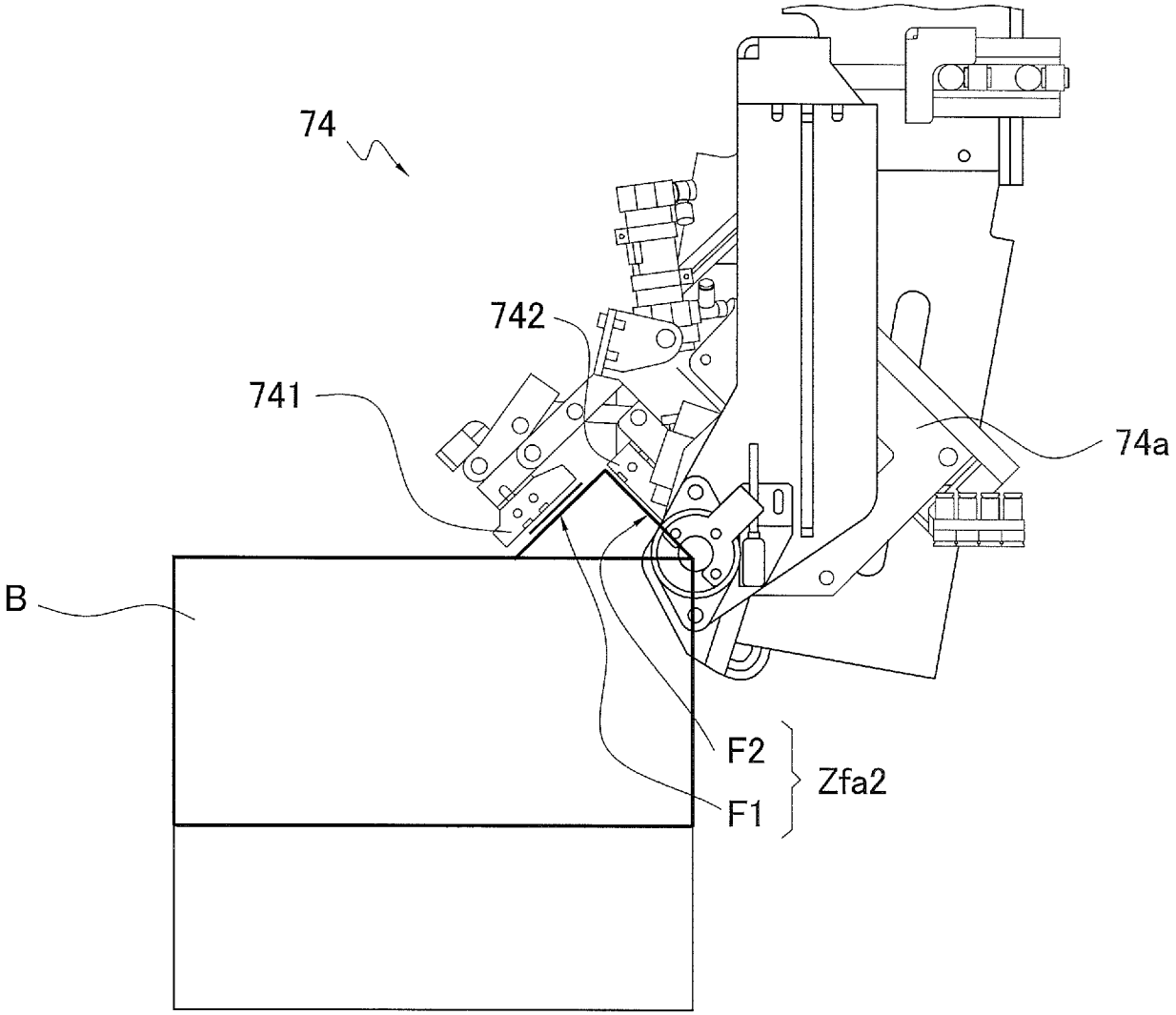
FIG. 7C is a side view of the second major flap folding mechanism when the first face retaining units and the second face retentions unit have bent the second major flap into a mountain shape.

Next, FIG. 7C is a side view of the second major flap folding mechanism 74 when the first face retaining units 741 and the second face retaining units 742 have bent the second major flap Zfa2 into a mountain shape. In FIG. 7C, the first face retaining units 741 pivot so that the relative angle they form with the second face retaining units 742 becomes the calculated bend angle θb.

Specifically, the extension of the pistons 744*a* of the crank air cylinders 744 turns the parallel cranks 743 coupled to the back sides of the first face retaining units 741, whereby the first face retaining units 741 pivot so that the distal end of the first face F1 lands on, or in front of, the slit portions—of the slit Slt3 in the first minor flap Zfa3 and the slit Slt4 in the second minor flap Zfa4 that were folded before—that are parallel to the distal end of the first face F1.

At this time, the first suction cups 741*a* continue to suck hold of the first face F1 and the second suction cups 742*a* continue to suck hold of the second face F2, and the distal end of the first face F1 lands on or in front of the slit portions as a result of the first face retaining units 741 pivoting.

It will be noted that although in the present embodiment the mountain-folding operation at the bend angle θb is performed after the second major flap Zfa2 has been inclined the predetermined angle θa with respect to the vertical plane, the mountain-folding operation is not limited to this. For example, the mountain-folding operation can also be configured in such a way that the second major flap Zfa2 is first folded until its inner surface touches the outer surfaces of the first minor flap Zfa3 and the second minor flap Zfa4 and thereafter, while pivoting the second major flap Zfa2 in the opposite direction, the first face retaining units 741 are pivoted so that the relative angle between the first face retaining units 741 and the second face retaining units 742 becomes the bend angle θb.

Because of this, the distal end of the first face F1 moves backward, and the distal end of the first face F1 reaches the top of, or the front of, the slit portions.

(6-4) Insertion Operation

Figure 7D:
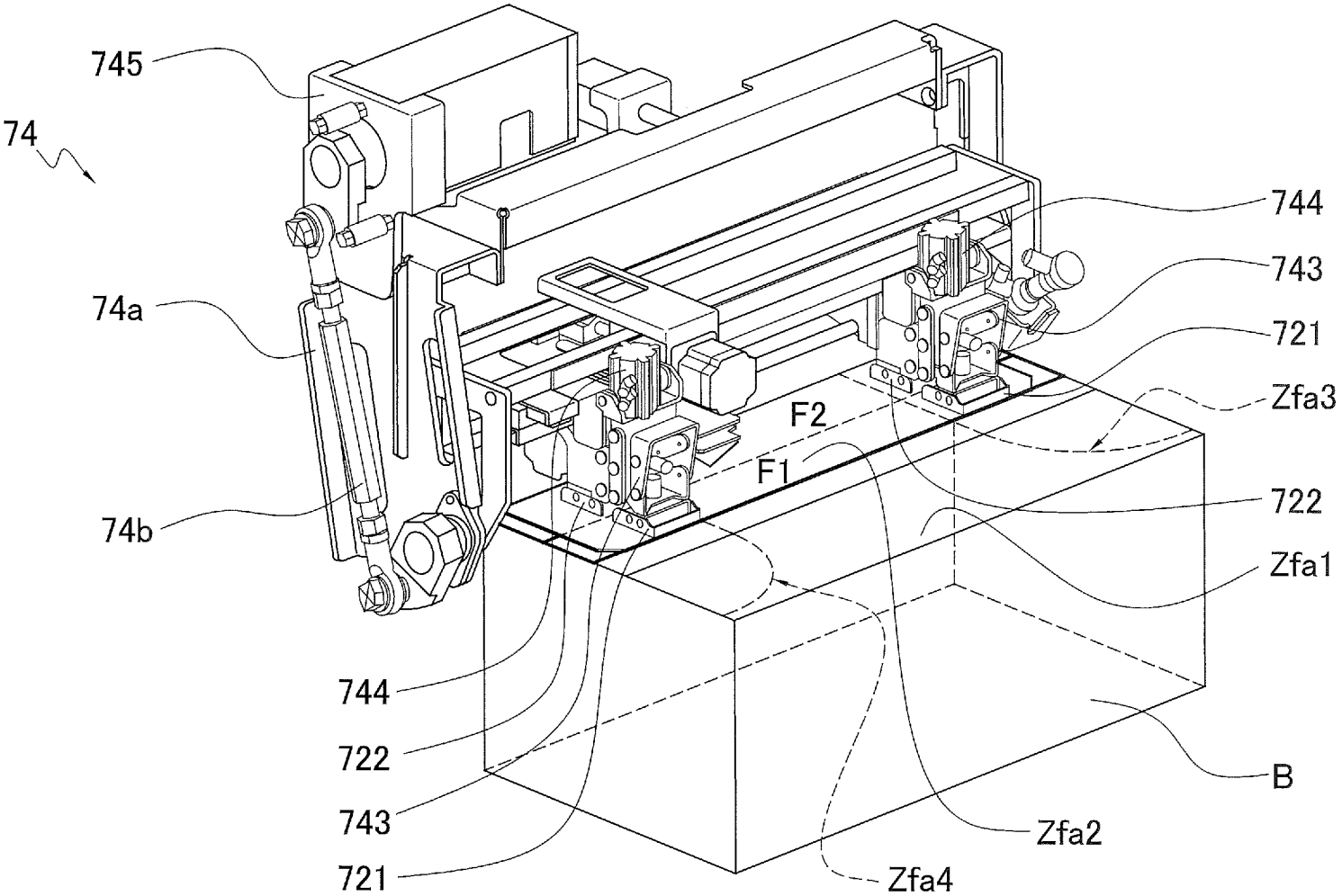
FIG. 7D is a perspective view of the second major flap folding mechanism when the first face retaining units and the second face retaining units have extended the second major flap.

FIG. 7D is a perspective view of the second major flap folding mechanism 74 when the first face retaining units 741 and the second face retaining units 742 have extended the second major flap Zfa2. The first face retaining units 741 and the second face retaining units 742 extend, into a flat planar shape, the second major flap Zfa2 that had been bent into a mountain shape. Specifically, the first face retaining units 741 pivot so that the relative angle between the first face retaining units 741 and the second face retaining units 742 becomes 180°. This is because the retraction of the pistons 744*a* of the crank air cylinders 744 turns the parallel cranks 743 coupled to the back sides of the first face retaining units 741, whereby the first face retaining units 741 pivot 90° in the opposite direction of the direction in which they pivoted during the mountain-folding operation.

At this time, the first suction cups 741*a* continue to suck hold of the first face F1 and the second suction cups 742*a* continue to suck hold of the second face F2, and the first face retaining units 741 pivot so that the relative angle they form with the second face retaining units 742 becomes 180°. As a result, the first suction cups 741*a* spread open the first face F1 in a direction away from the second face F2.

At this time, the distal end of the first face F1 goes under the first minor flap Zfa3 and the second minor flap Zfa4 through the slit portions—of the slit Slt3 in the first minor flap Zfa3 and the slit Slt4 in the second minor flap Zfa4—that are parallel to the distal end of the first face F1.

When the distal end of the first face F1 enters the slit Slt3 in the first minor flap Zfa3 and the slit Slt4 in the second minor flap Zfa4, at least one of a first face release operation, in which the first suction cups 741*a* release the first face F1 of the second major flap Zfa2 that they had been sucking hold of, and a second face release operation, in which the second suction cups 742*a* release the second face F2 of the second major flap Zfa2 that they had been sucking hold of, is performed.

It will be noted that these release operations can be performed at an arbitrary pivot angle of the second major flap Zfa2. When the second major flap Zfa2 is released in an arbitrary position and enters the slit Slt3 in the first minor flap Zfa3 and the slit Slt4 in the second minor flap Zfa4, the second major flap Zfa2 naturally transitions to a horizontal state.

Therefore, the timing when the distal end of the second major flap Zfa2 enters the slit Slt3 in the first minor flap Zfa3 and the slit Slt4 in the second minor flap Zfa4 becomes unstrict.

As a result of the distal end of the first face F1 having gone under the first minor flap Zfa3 and the second minor flap Zfa4, a locked state is finished in which the first major flap Zfa1 is held down from both sides by the first minor flap Zfa3 and the second minor flap Zfa4, the first minor flap Zfa3 and the second minor flap Zfa4 are held down from above by the second major flap Zfa2, and the second major flap Zfa2 is held down from above by the first minor flap Zfa3 and the second minor flap Zfa4. Because of this, the stability of the case closure is improved.

(7) Characteristics 7-1

In the lid forming device 340, the second major flap Zfa2 that has been bent is extended, whereby the distal end of the second major flap Zfa2 enters the slit Slt3 in the first minor flap Zfa3 and the slit Slt4 in the second minor flap Zfa4, so an unnecessary load is not applied to the second major flap Zfa2, there is also no buckling of the second major flap Zfa2, and the distal end thereof becomes easily inserted into the slit Slt3 in the first minor flap Zfa3 and the slit Slt4 in the second minor flap Zfa4.

7-2

The second major flap folding mechanism 74 of the lid forming device 340 bends the second major flap Zfa2 by retaining the second major flap Zfa2 with the first face retaining units 741 and the second face retaining units 742 and individually moving the first face retaining units 741 and the second face retaining units 742 until the relative angle between the first face F1 and the second face F2 of the second major flap Zfa2 decreases to the predetermined angle (90°). Therefore, loads can be applied equally to the first face F1 and the second face F2, and bending defects are reduced.

7-3

The second major flap folding mechanism 74 of the lid forming device 340 places the distal end of the second major flap Zfa2 that has been bent into a mountain shape along the top of, or the upper surface in front of, the slit portions—of the slit Slt3 in the first minor flap Zfa3 and the slit Slt4 in the second minor flap Zfa4—that are parallel to the distal end of the first face F1 and at the same time individually moves the first face retaining units 741 and the second face retaining units 742 in directions in which the relative angle between the first face F1 and the second face F2 of the second major flap Zfa2 increases, and guides the distal end of the second major flap Zfa2 to the slit Slt3 in the first minor flap Zfa3 and the slit Slt4 in the second minor flap Zfa4. Therefore, an unnecessary load is not applied to the second major flap Zfa2, and the distal end of the second major flap Zfa2 is smoothly inserted into the slit Slt3 in the first minor flap Zfa3 and the slit Slt4 in the second minor flap Zfa4 without becoming deformed.

7-4

The first face retaining units 741 have the first suction cups 741*a* that suck hold of the first face F1, and the second face retaining units 742 have the second suction cups 742*a* that suck hold of the second face F2, so compared to a case where the second major flap Zfa2 is mechanically caught, concentration of stress in the second major flap Zfa2 is mitigated, and deformation and the like can be inhibited.

7-5

The first face retaining units 741 have the first covers 741*b* that surround parts of the peripheries of the first suction cups 741*a*, and the second face retaining units 742 have the second covers 742*b* that surround parts of the peripheries of the second suction cups 742*a*. As a result, when bending the second major flap Zfa2, the first suction cups 741*a* simply suck hold of the first face F1 and the second suction cups 742*a* simply suck hold of the second face F2, and the first covers 741*b* fulfill the role of transmitting force to the first face F1 during bending and the second covers 742*b* fulfill the role of transmitting force to the second face F2, so the first suction cups 741*a* and the second suction cups 742*a* are inhibited from sustaining damage due to friction.

7-6

When the distal end of the first face F1 enters the slit Slt3 in the first minor flap Zfa3 and the slit Slt4 in the second minor flap Zfa4, at least one of the first face release operation, in which the first suction cups 741*a* release the first face F1 of the second major flap Zfa2 that they had been sucking hold of, and the second face release operation, in which the second suction cups 742*a* release the second face F2 of the second major flap Zfa2 that they had been sucking hold of, is performed.

As a result, the second major flap Zfa2 is released, the distal end of the first face F1 enters the slit Slt3 in the first minor flap Zfa3 and the slit Slt4 in the second minor flap Zfa4, and the second major flap Zfa2 naturally transitions to a horizontal state. Therefore, the timing when the distal end of the second major flap Zfa2 enters the slit Slt3 in the first minor flap Zfa3 and the slit Slt4 in the second minor flap Zfa4 becomes unstrict.

(8) Miscellaneous

The case closing method resulting from the lid forming device pertaining to the above embodiment is usually called a slide lock, and the four top flaps Zfa must be folded inward in a prescribed order.

However, when a cardboard box is repeatedly reutilized, sometimes the fold lines of the flaps become weak, and a flap other than the first major flap Zfa1 that is the first to be folded inward collapses inward before the first major flap Zfa1. In such a case, a mechanism that outwardly pulls up and retains the flap is needed.

If a hook-shaped member is rotated by a simple rotating mechanism to catch and outwardly pull up the inwardly collapsed flap, when the length of the box is short, the hook hits the opposing flap and conversely ends up collapsing the flap inward.

In order to solve this, conventionally a rotary air cylinder has been attached to the distal end of a linear air cylinder, and the hook-shaped member has been attached to the rotary air cylinder. The rotary air cylinder rotates as the linear air cylinder extends from above toward the distal end of the flap, and the linear cylinder retracts after catching the inwardly collapsed flap, whereby the flap is outwardly pulled up and retained.

This allows the inwardly collapsed flap to be outwardly pulled up without the hook hitting the opposing flap.

However, this mechanism requires two air cylinders, and it becomes cumbersome to route air tubes during assembly. Furthermore, in order to optimize the circular path traced by the hook, the operating speeds of the two air cylinders must be fine-tuned, and the operating speeds of the air cylinders change depending on the fine tuning of the air flow rate, so it is difficult to ensure stability.

In order to solve the above problem, a freely rotating pinion gear is attached to the distal end of one linear air cylinder anchored in the horizontal direction. The pinion gear meshes with a rack gear anchored in the horizontal direction to form a rack and pinion mechanism.

Figure 8:
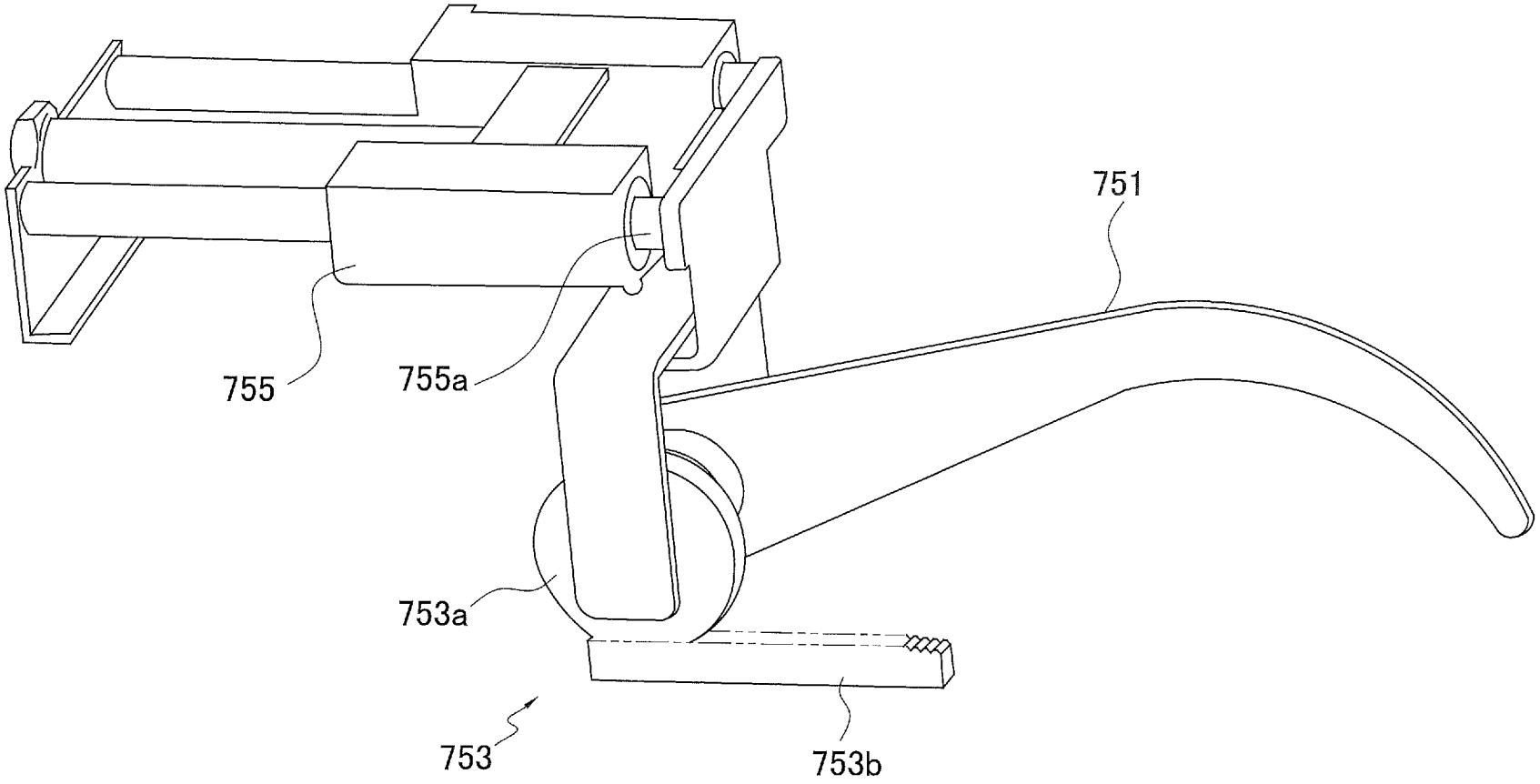
FIG. 8 is a perspective view of a hook-shaped member that is operated by a rack and pinion mechanism.

FIG. 8 is a perspective view of a hook-shaped member 751 that is operated by a rack and pinion mechanism 753. In FIG. 8, the hook-shaped member 751 is attached to a shaft 751*a* to which a pinion gear 753*a* is anchored, and a piston 755*a* of a hook air cylinder 755 linearly moves, whereby the hook-shaped member 751 pivots while moving in the horizontal direction along a rack 753*b*.

By optimizing the stroke of the hook air cylinder 755 and the diameter of the pinion gear 753*a*, the circular path traced by the distal end of the hook-shaped member 751 is defined, and the hook-shaped member 751 moves on a path in which it pulls up the inwardly collapsed flap (the second minor flap Zfa4) without hitting the opposing flap (the first minor flap Zfa3).

As described above, the hook-shaped member 751 is operated by the one hook air cylinder 755, so the air tube is not cumbersome. Furthermore, the circular path traced by the hook-shaped member 751 is always fixed regardless of the operating speed, so the flap (the second minor flap Zfa4) can be stably pulled up regardless of the air flow rate.

Second Embodiment

In the first embodiment, the first suction cups 741*a*, the second suction cups 742*a*, the crank air cylinders 744, and the drive motor 745 (servo motor) are combined to perform the operation of folding the second major flap Zfa2.

However, there is the concern that the air cylinders will not realize their intended operations due to factors such as degradation over time and insufficient adjustment. Therefore, it is necessary to control the first suction cups 741*a*, the second suction cups 742*a*, and the drive motor 745 while checking the status (e.g., operating time) of the crank air cylinders 744.

The crank air cylinders 744 simply have sensors that detect the starting point and the ending point of the operation of the pistons 744*a*, and cannot measure in real time the operating time of the pistons 744*a*.

Thus, in a second embodiment, the controller 40 stores, as the operating time of the pistons 744*a*, the time interval between the starting point and the ending point of the most recent operation of the pistons 744*a* and, in accordance with that operating time, changes to an optimal state the operating pattern (speed, acceleration, deceleration) of the drive motor 745 and the cancellation timing of the first suction cups 741*a* and the second suction cups 742*a*.

Figure 10:
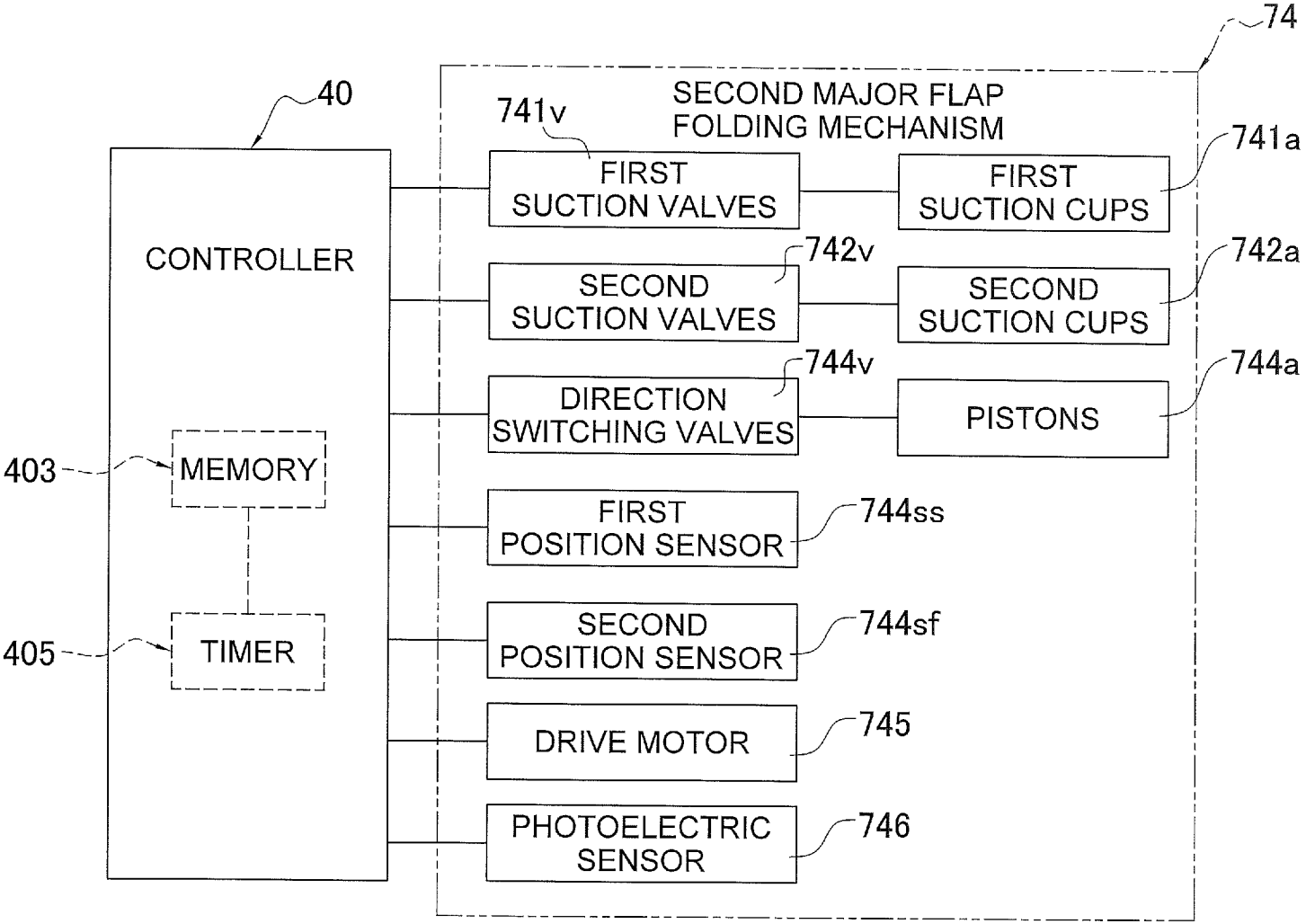
FIG. 10 is a block diagram showing electrical connections between a controller, first suction cups, second suction cups, pistons of crank air cylinders, and a drive motor.
Figure 11:
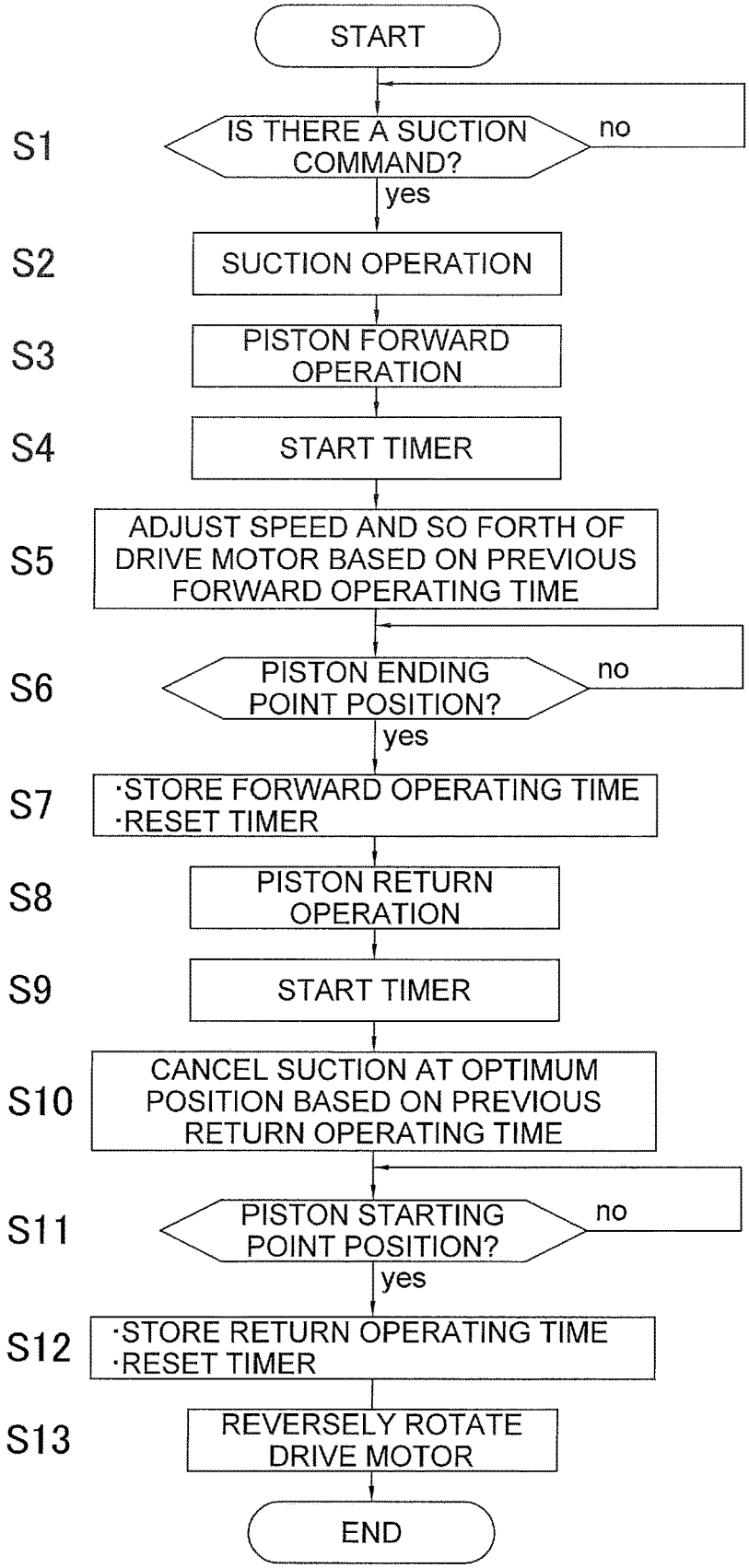
FIG. 11 is a flowchart of operations of folding the second major flap.

FIG. 10 is a block diagram showing electrical connections between the controller 40, the first suction cups 741*a*, the second suction cups 742*a*, the pistons 744*a* of the crank air cylinders 744, and the drive motor 745. Furthermore, FIG. 11 is a flowchart of operations of folding the second major flap Zfa2.

Referring first to FIG. 10, connected to the controller 40 are first suction valves 741*v*, second suction valves 742*v*, direction switching valves 744*v*, a first position sensor 744*ss*, a second position sensor 744*sf*, and the drive motor 745.

The first suction valves 741*v* are valves that cause the first suction cups 741*a* to suck or cancel the suction. When the first suction valves 741*v* are open, the first suction cups 741*a* perform the suction operation, and when the first suction valves 741*v* are closed, the first suction cups 741*a* cancel the suction.

The second suction valves 742*v* are valves that cause the second suction cups 742*a* to suck or cancel the suction. When the second suction valves 742*v* are open, the second suction cups 742*a* perform the suction operation, and when the second suction valves 742*v* are closed, the second suction cups 742*a* cancel the suction.

The direction switching valves 744*v* are valves that cause the pistons 744*a* of the crank air cylinders 744 to reciprocally operate. When the direction switching valves 744*v* are in forward mode, the pistons 744*a* move on a forward path, and when the direction switching valves 744*v* are in return mode, the pistons 744*a* move on a return path.

The first position sensor 744*ss* is a sensor that detects that the pistons 744*a* are in a starting point position. Furthermore, the second position sensor 744*sf* is a sensor that detects that the pistons 744*a* are positioned in an ending point of the forward path.

The drive motor 745 is a servo motor. When the drive motor 745 rotates, the frame 74*a* pivots, so the first face retaining units 741 and the second face retaining units 742 integrally pivot.

(1) Operation of Folding Second Major Flap Zfa2

Below, the coordinated operations of the first suction cups 741*a*, the second suction cups 742*a*, the crank air cylinders 744, and the drive motor 745 will be described with reference to the flowchart (FIG. 11) of the operation of folding the second major flap Zfa2.

(Step S1)

In step S1, the controller 40 determines whether or not there is a suction command. When the controller 40 determines that there is a suction command, it proceeds to step S2. When the controller 40 does not determine that there is a suction command, it continues the determination operation.

(Step S2)

Next, in step S2, the controller 40 opens the first suction valves 741*v* and the second suction valves 742*v* to cause the first suction cups 741*a* to suck hold of the first face F1 and cause the second suction cups 742*a* to suck hold of the second face F2.

(Step S3)

Next, in step S3, the controller 40 switches the direction switching valves 744*v* to the forward mode in which the pistons 744*a* move in the forward direction. Because of this, the pistons 744*a* operate and the operation of mountain-folding the second major flap Zfa2 is started.

Step S4

Next, in step S4, the controller 40 starts a timer 405 and counts an amount of elapsed time t since the point in time when it was detected via the first position sensor 744*a* that the pistons 744*a* left the starting point position.

(Step S5)

Next, in step S5, the controller 40 operates the drive motor 745 to incline the second major flap Zfa2 the angle θa with respect to the vertical plane. In the second embodiment, the drive motor 745 operates later than the operation of the pistons 744*a*.

Furthermore, the controller 40 estimates the position of the pistons 744*a* on the basis of the forward operating time that it stored the previous time and adjusts the acceleration, speed, and deceleration of the drive motor 745 on the basis of the estimated position.

(Step S6)

Next, in step S6, the controller 40 determines via the second position sensor 744*sf* whether or not the pistons 744*a* have reached the ending point position in the forward direction. When the controller 40 determines that the pistons 744*a* have reached the ending point position, it proceeds to step S7, and when the controller 40 does not determine that the pistons 744*a* have reached the ending point position, it continues the determination.

(Step S7)

Next, in step S7, the controller 40 stores, in a memory 403 as a forward operating time tA (n) of the pistons 744*a*, the amount of elapsed time t from the point in time when it was detected that the pistons 744*a* left the starting point position to the point in time when it was detected that the pistons 744*a* reached the ending point position and resets the timer 405.

It will be noted that the controller 40 estimates the position of the pistons 744*a* on the basis of the forward operating time tA (n−1) that it stored the previous time and adjusts the acceleration, speed, and deceleration of the drive motor 745 on the basis of the estimated position.

Therefore, the forward operating time tA (n) that has been stored here is utilized for position estimation in the subsequent (n+1) forward operation of the pistons 744*a*.

(Step S8)

Next, in step S8, the controller 40 switches the direction switching valves 744*v* to the return mode in which the pistons 744*a* move in the return direction.

(Step S9)

Next, in step S9, the controller 40 starts the timer 405 and counts the amount of elapsed time t since the point in time when it was detected via the second position sensor 744*sf* that the pistons 744*a* left the ending point position.

(Step S10)

Next, in step S10, the controller 40 estimates the position of the pistons 744*a* on the basis of the return operating time that it stored the previous time and, on the basis of the estimated position, cancels the suction of the first face F1 by the first suction cups 741*a* and the suction of the second face F2 by the second suction cups 742*a*. Specifically, the controller 40 closes the first suction valves 741*v* and the second suction valves 742*v* to thereby cancel the suction of the first face F1 by the first suction cups 741*a* and the suction of the second face F2 by the second suction cups 742*a*.

(Step S11)

Next, in step S11, the controller 40 determines via the first position sensor 744*ss* whether or not the pistons 744*a* have reached the starting point position. When the controller 40 determines that the pistons 744*a* have reached the starting point position, it proceeds to step S12. When the controller 40 does not determine that the pistons 744*a* have reached the starting point position, it continues the determination.

(Step S12)

Next, in step S12, the controller 40 stores, in the memory 403 as a return operating time tB (n) of the pistons 744*a*, the amount of elapsed time t from the point in time when it was detected that the pistons 744*a* left the ending point position to the point in time when it was detected that the pistons 744*a* reached the starting point position and resets the timer 405.

It will be noted that the controller 40 estimates the position of the pistons 744*a* on the basis of the return operating time tB (n−1) that it stored the previous time and adjusts, on the basis of the estimated position, the timing when it cancels the suction of the first face F1 by the first suction cups 741*a* and the timing when it cancels the suction of the second face F2 by the second suction cups 742*a*.

Therefore, the return operating time tB (n) that has been stored here is utilized for position estimation in the subsequent (n+1) return operation of the pistons 744*a*.

(Step S13)

Then, in step S13, the controller 40 reversely rotates the drive motor 745 to thereby cause the first suction cups 741*a* and the second suction cups 742*a* to pivot the angle θa so that they become parallel to the vertical plane.

As described above, the controller 40 adjusts the acceleration, speed, and deceleration of the drive motor 745, the timing when it cancels the suction of the first face F1 by the first suction cups 741*a*, and the timing when it cancels the suction of the second face F2 by the second suction cups 742*a* on the basis of the previous forward operating time and return operating time of the pistons 744*a*.

(2) Characteristics of Second Embodiment

For example, if the forward operating time of the pistons 744*a* has become long due to degradation over time, there is the concern that the mountain-folding operation will not be completed even though the drive motor 745 has caused the second major flap Zfa2 to pivot the angle θa and that the distal end portion of the first face F1 of the second major flap Zfa2 will not reach the intended position of the slit Slt3 and the slit Slt4.

However, because the controller 40 adjusts the acceleration, speed, and deceleration of the drive motor 745 on the basis of the previous forward operating time of the pistons 744*a*, the distal end portion of the first face F1 of the second major flap Zfa2 can reach the intended position of the slit Slt3 and the slit Slt4.

Furthermore, if the return operating time of the pistons 744*a* has become long due degradation over time, there is the concern that the suction of the first face F1 by the first suction cups 741*a* and the suction of the second face F2 by the second suction cups 742*a* will be cancelled at a time when the first face retaining units 741 and the second face retaining units 742 have not finished extending the second major flap Zfa2.

However, because the controller 40 adjusts the timing when it cancels the suction of the first face F1 by the first suction cups 741*a* and the suction of the second face F2 by the second suction cups 742*a* on the basis of the previous return operating time of the pistons 744*a*, the suction of the first face F1 by the first suction cups 741*a* and the suction of the second face F2 by the second suction cups 742*a* is cancelled after the first face retaining units 741 and the second face retaining units 742 finish extending the second major flap Zfa2.

Consequently, even if the operation of the pistons 744*a* of the crank air cylinders 744 is unstable, the first suction cups 741*a*, the second suction cups 742*a*, and the drive motor 745 perform operations suited to the operating time of the pistons 744*a*, so the series of operations of the second major flap folding mechanism 74 is stable.

Third Embodiment

The structure of a third embodiment is the same as that of the first embodiment and the second embodiment, but the operation of inserting the second major flap Zfa2 into the slit Slt3 and the slit Slt4 differs from that of the first embodiment and the second embodiment.

(1) Insertion Operation

Figure 12A:
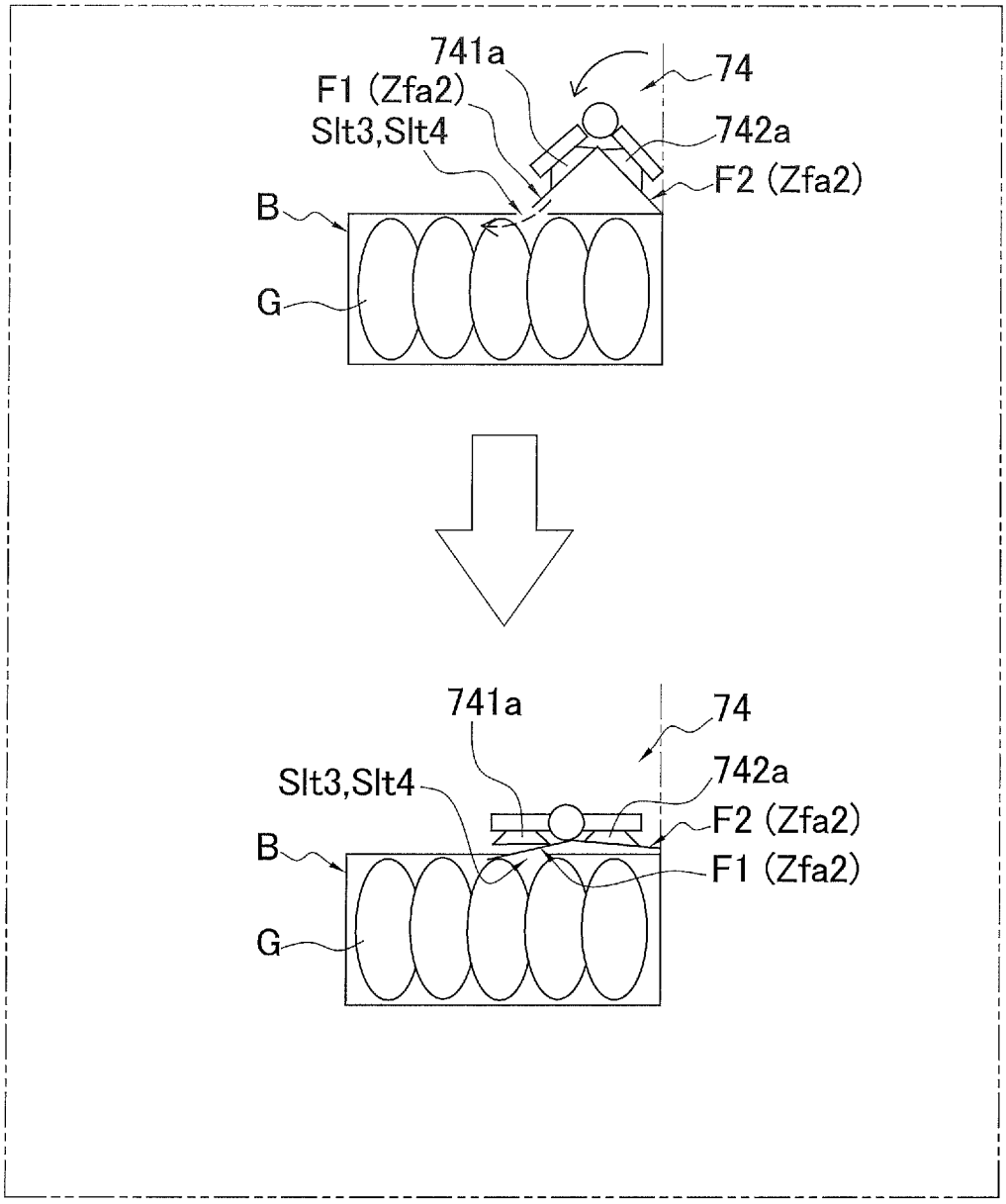
FIG. 12A is a schematic view showing a normal operation of inserting the second major flap.
Figure 12B:
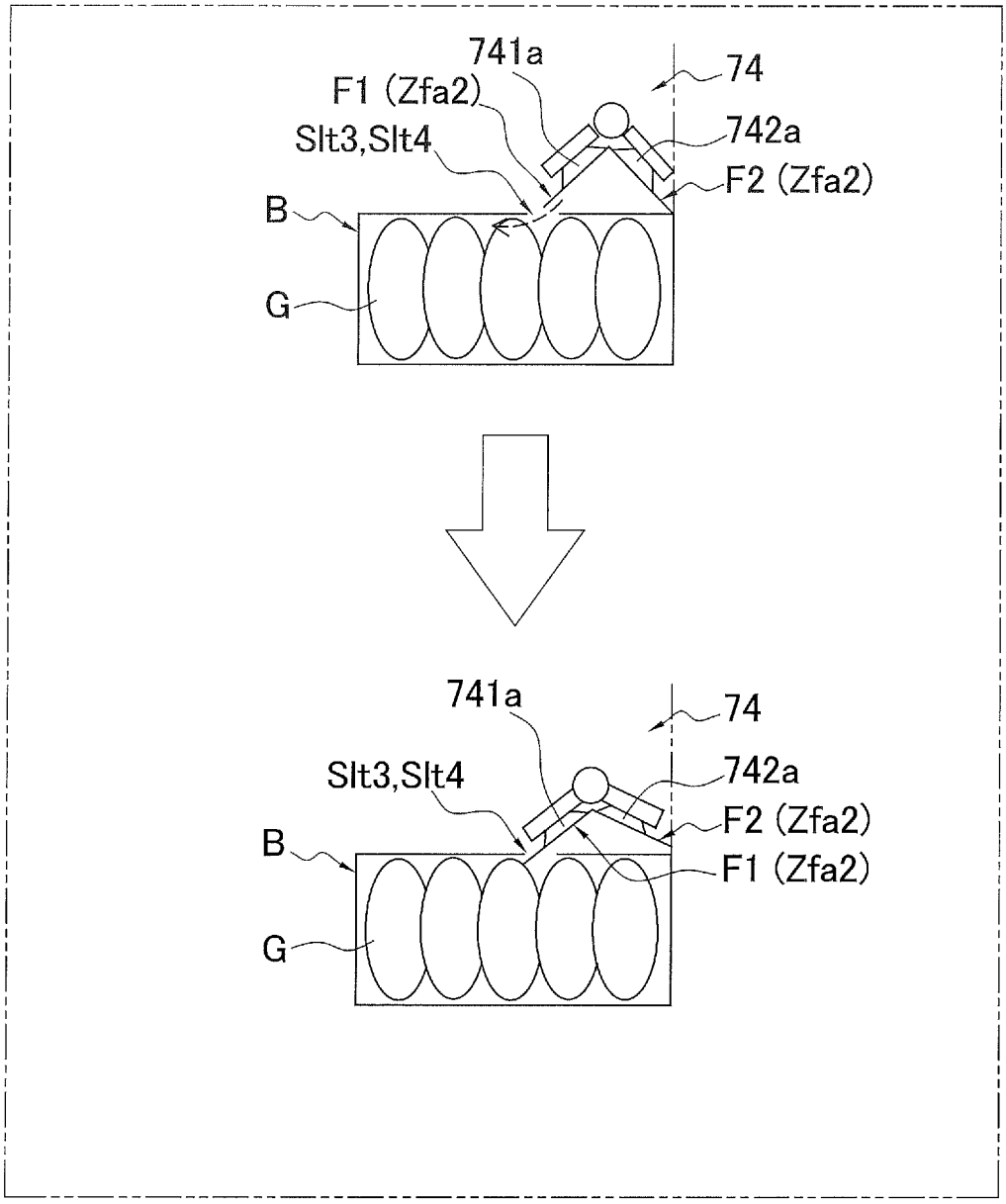
FIG. 12B is a schematic view showing an operation of inserting the second major flap in a case where the fill rate of bags (products) in a cardboard box is high.

FIG. 12A is a schematic view showing a normal operation of inserting the second major flap Zfa2. FIG. 12B is a schematic view showing an operation of inserting the second major flap Zfa2 in a case where the fill rate of the bags (products G) in the cardboard box B is high.

As shown in FIG. 12A, normally the corner of the distal end portion of the first face F1 of the second major flap Zfa2 that had been bent into a mountain shape enters the slit Slt3 and the slit Slt4, thereafter the second major flap Zfa2 is extended into a flat planar shape, and the corner of the distal end portion of the first face F1 goes under the first minor flap Zfa3 and the second minor flap Zfa4 through the slit Slt3 and the slit Slt4.

However, as shown in FIG. 12B, in a case where the fill rate of the bags in the cardboard box B is high, there are cases where the bags interfere with the distal end portion of the first face F1 that is inserted, so that the flap cannot be inserted well.

Furthermore, in the case of a cardboard box where slits have covers, a situation arises where the covers get in the way and the first face F1 cannot be inserted well into the slits.

Thus, in the third embodiment, the second major flap folding mechanism 74 inserts the corner of the distal end portion of the first face F1 of the second major flap Zfa2 deep inside through the slit Slt3 and the slit Slt4, thereafter lifts up the second major flap Zfa2 to an extent that the corner of the distal end portion of the first face F1 does not come out of the slit Slt3 and the slit Slt4, and then reinserts the distal end portion of the first face F1.

Figure 12C:
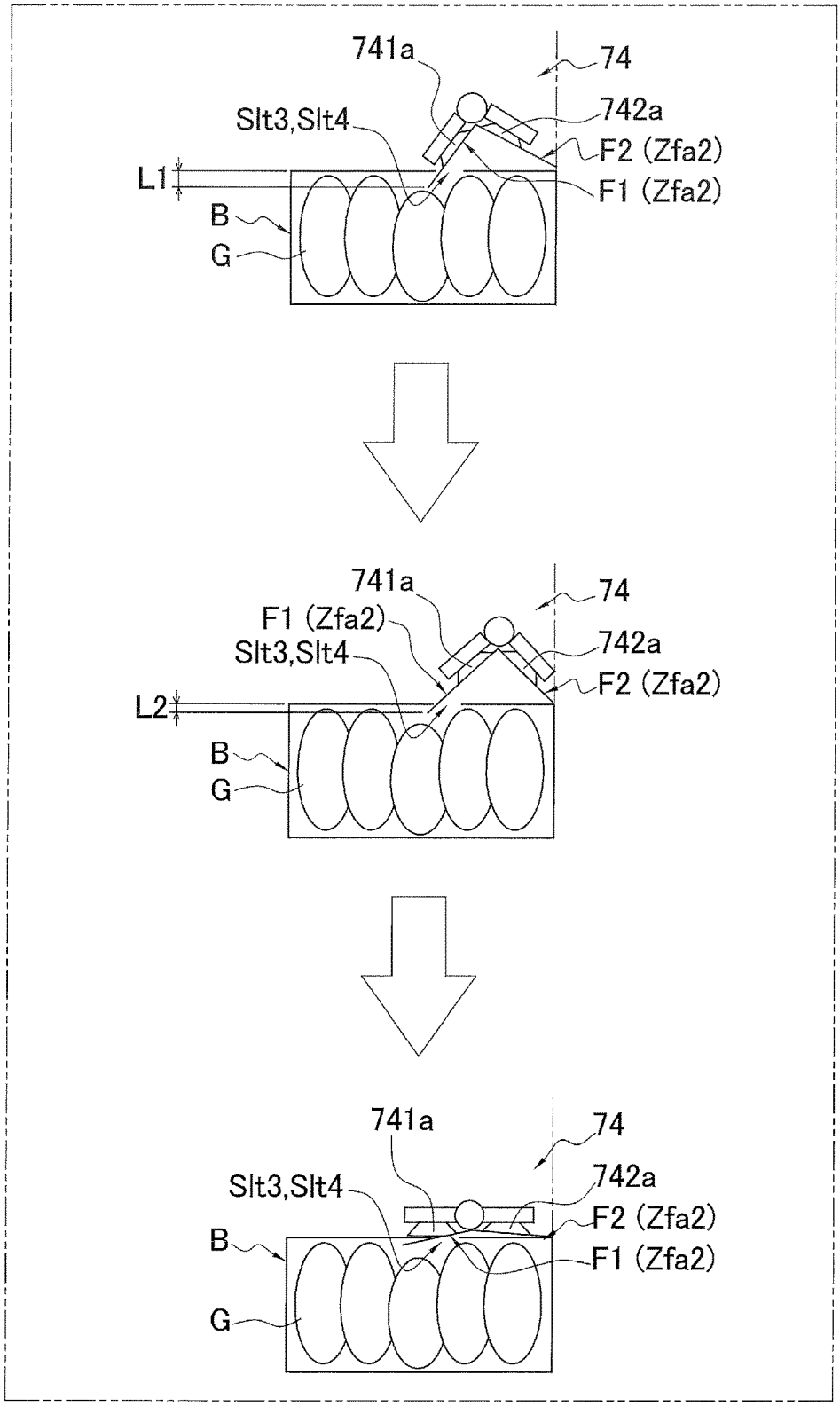
FIG. 12C is a schematic view showing an operation of inserting the second major flap in a third embodiment.

FIG. 12C is a schematic view showing an operation of inserting the second major flap Zfa2 in the third embodiment. In FIG. 12C, as a first operation, the second major flap folding mechanism 74 inserts the corner of the distal end portion of the first face F1 of the second major flap Zfa2 that has been bent into a mountain shape into the slit Slt3 and the slit Slt4. At that time, a first range of the corner of the distal end portion that is a first dimension L1 from the free end of the first face F1 is inserted into the slit Slt3 and the slit Slt4. This state will be called a first insertion state.

After the first insertion state has been formed, a second range of the corner of the distal end portion that is a second dimension L2 smaller than the first dimension L1 from the free end of the first face F1 is inserted into the slit Slt3 and the slit Slt4. This state will be called a second insertion state.

After forming the second insertion state, the second major flap folding mechanism 74 extends the second major flap Zfa2 and inserts the corner of the distal end portion that has been inserted into the slit Slt3 and the slit Slt4 further toward the far sides of the slit Slt3 and the slit Slt4 as a second operation.

(2) Characteristics of Third Embodiment

As described above, even in a case where the fill rate of the bags in the cardboard box B is high, the bags are pushed in by the second major flap Zaf2 by the formation of the first insertion state in the first operation, so at the time of the second operation that is performed thereafter, interference between the second major flap Zfa2 and the bags can be inhibited.

Furthermore, even in a case where the slits have covers, the covers can be opened by the first insertion state, so failure to insert the second major flap Zfa2 due to the presence of covers is avoided.

It will be noted that the operation of inserting the second major flap Zfa2 into the slit Slt3 and the slit Slt4 in the third embodiment is also applicable to the first embodiment.

(3) Example Modification of Third Embodiment

At the timing when the operation of inserting the second major flap Zfa2 is completed, a sensor can also be used to determine whether or not the insertion operation has been completed normally.

Figure 13:
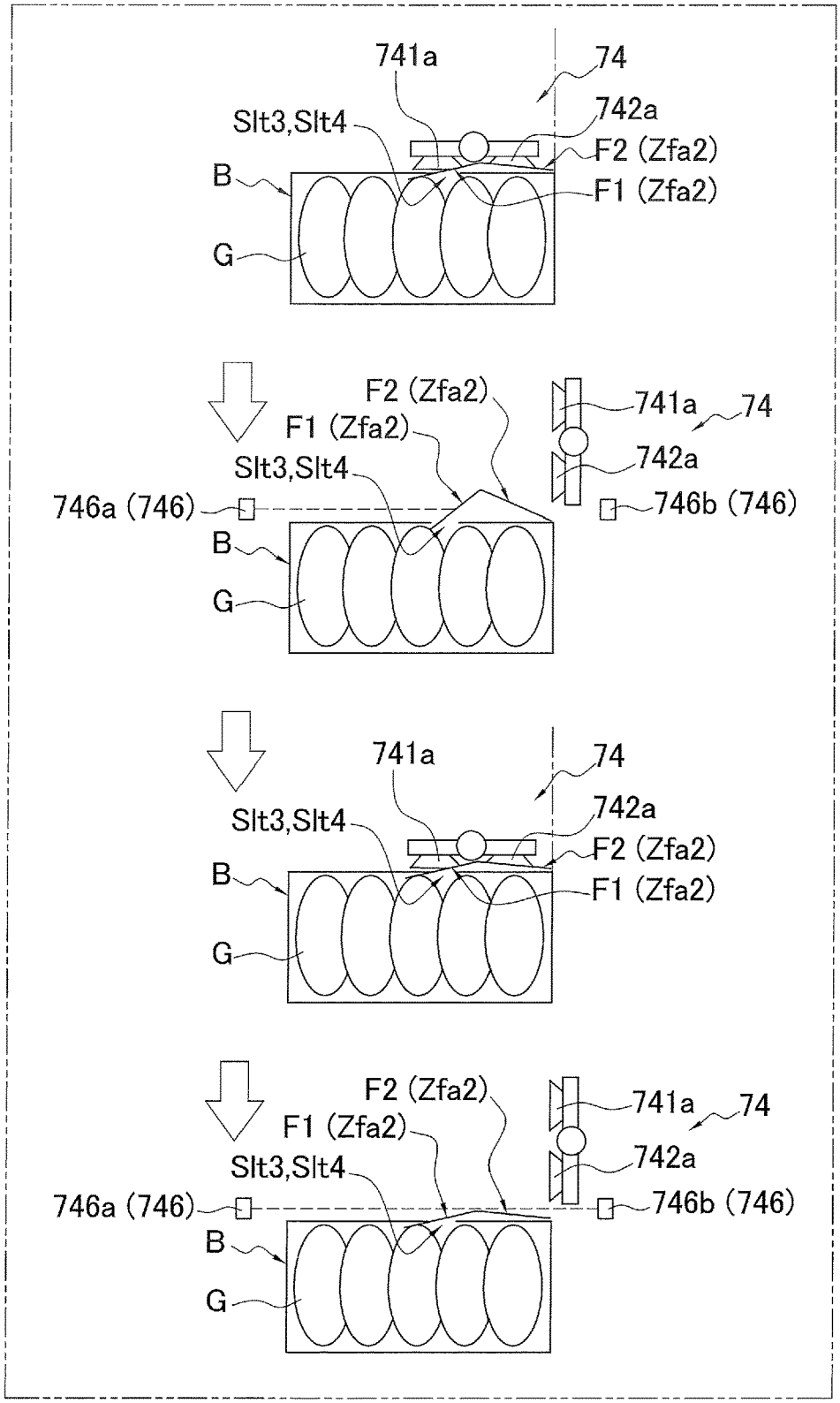
FIG. 13 is a schematic view showing a series of operations performed by the second flap folding mechanism when the operation of inserting the second major flap has not been completed normally.

FIG. 13 is a schematic view showing a series of operations performed by the second major flap folding mechanism 74 when the operation of inserting the second major flap Zfa3 has not been completed normally.

In FIG. 13, a sensor 746 is a photoelectric sensor. The sensor 746 has a light transmitter 746*a* and a light receiver 746*b*. The light transmitter 746*a* and the light receiver 746*b* are disposed a predetermined interval apart from each other at a predetermined height position, and light (e.g., infrared) is projected from the light transmitter 746*a*. The controller 40 judges that there is no object detected between the light transmitter 746*a* and the light receiver 746*b* if the light is not blocked and is detected by the light receiver 746*b*.

The predetermined height position is set to a position a predetermined distance higher than the upper end of the cardboard box B.

As shown in FIG. 13, in a case where the bend line BL portion is not flat but is sticking up because the operation of inserting the second major flap Zfa2 was not completed normally, the light projected from the light transmitter 746*a* is blocked by the bend line BL portion sticking up and is not detected by the light receiver 746*b*.

In this case, the controller 40 judges that the operation of inserting the second major flap Zfa2 was not completed normally. Then, as shown in FIG. 13, the controller 40 tilts the first face retaining units 741 and the second face retaining units 742 in the direction of the cardboard box B to thereby push in the second major flap Za2.

Alternatively, the controller 40 can also suck hold of the second major flap Zfa2 via the first face retaining units 741 and the second face retaining units 742 and perform the folding operation again.

In this example modification, even if a folding defect occurs, it is not necessary for the operator to stop the device, and a reduction in the operating rate of the device can be inhibited.

It will be noted that this example modification is not limited to the third embodiment and is also applicable to the first embodiment and the second embodiment.

Fourth Embodiment

The structure of a fourth embodiment differs from that of the first embodiment in that the mountain-folding operation of bending the second major flap Zfa2 along the bend line BL is performed by servo motors 747 instead of the crank air cylinders 744.

In the first embodiment, as shown in FIG. 9, the second major flap Zfa2 is bent along the bend line BL by the mountain-folding operation, so if the position of the bend line BL changes, the combination of the length A of the first face F1 and the length X of the second face F2 becomes different, and the predetermined angle θa is also changed to make an adjustment so that the distal end of the first face F1 after being bent reaches an appropriate landing point.

In order for the landing point of the distal end of the first face F1 after being bent to be in a position the distance D from the base of the second major flap Zfa2, the bend angle θb is calculated from the length A of the first face F1, the length X of the second face F2, the predetermined angle θa, and the distance D, and in the first embodiment the bend angle θb is fixed at 90°.

This is due to the fact that the pivoting of the first face retaining units 741 uses as a drive source the pistons 744*a* provided in the parallel cranks 743, and it is not easy to change and adjust the pivot angle.

Figure 14:
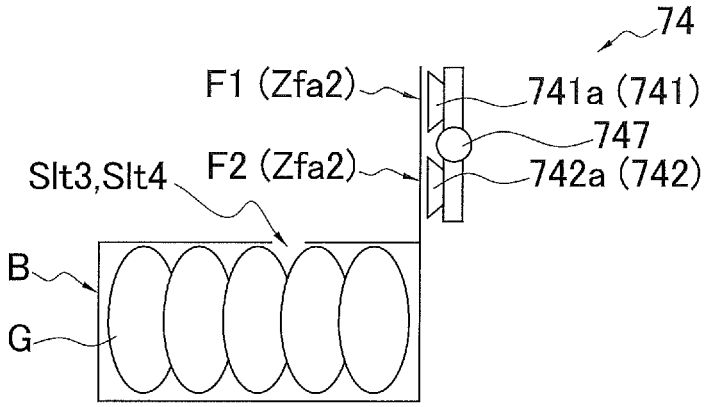
FIG. 14 is a schematic side view of the second major flap folding mechanism in a fourth embodiment.

Thus, in the fourth embodiment, as shown in FIG. 14 (a schematic side view of the second major flap folding mechanism), the first face retaining units 741 are pivoted by the servo motors 747 in order to make it easier to set the relative angle between the first face retaining units 741 and the second face retaining units 742 to the desired bend angle θb. In the fourth embodiment, the bend angle θb is set in the range of 90 to 120 degrees.

REFERENCE SIGNS LIST

40 Controller (Control Unit)
72 First Minor Flap Folding Mechanism (First Folding Mechanism)
73 Second Minor Flap Folding Mechanism (First Folding Mechanism)
74 Second Major Flap Folding Mechanism (Second Folding Mechanism)
405 Timer (Measuring Unit)
741 First Face Retaining Units (Second Drive Units)
741*a* First Suction Cups
741*b* First Covers
741*v* First Suction Valves
742 Second Face Retaining Units (Second Drive Units)
742*a* Second Suction Cups
742*b* Second Covers
742*v* Second Suction Valves
744 Crank Air Cylinders (Third Drive Units)
744*a* Pistons

744*v* Direction Switching Valves
744*ss* First Position Sensor
744*sf* Second Position Sensor
745 Drive Motor (First Drive Unit)
746 Photoelectric Sensor (Detection Unit)
747 Servo Motors
340 Lid Forming Device
B Cardboard Box
BL Bend Line
F1 First Face
F2 Second Face
Slt3 Slit
Slt4 Slit
Zfb2 Second Major Flap (Second Flap)
Zfb3 First Minor Flap (First Flap)
Zfb4 Second Minor Flap (First Flap)

What is claimed is:

1. A lid forming device that forms a lid of a cardboard box using, out of a group of flaps having a cantilever structure and provided on edges of an opening of the cardboard box, a first flap in which a slit is formed and a second flap to be extended after being bent into a mountain shape, the lid forming device comprising:

a first folding mechanism configured to fold the first flap in a direction in which the first flap closes the opening; and a second folding mechanism configured to bend the second flap into a mountain shape and insert part of the second flap into the slit of the first flap while extending the second flap, wherein the second folding mechanism includes a first retaining unit configured to retain a first face of the second flap located between a free end of the second flap and a bend line set beforehand in the second flap and a second retaining unit configured to retain a second face of the second flap located between an anchored end of the second flap and the bend line; and wherein the second folding mechanism is further configured to retain the second flap using the first retaining unit and the second retaining unit and bend the second flap by moving the first retaining unit and the second retaining unit until a relative angle between the first face and the second face of the second flap decreases to a predetermined angle.

2. The lid forming device according to claim 1, wherein the second folding mechanism is further configured to individually move the first retaining unit and the second retaining unit in a direction in which the relative angle between the first face and the second face of the second flap increases while placing a distal end of the second flap that has been bent along an upper surface of the first flap, and guide the free end of the second flap to the slit in the first flap.

3. The lid forming device according to claim 1, wherein the first retaining unit has a first suction device configured to suck the first face, and the second retaining unit has second suction device configured to suck the second face.

4. The lid forming device according to claim 3, wherein the first retaining unit further has a first cover that surrounds a part of a periphery of the first suction device, and the second retaining unit further has a second cover that surrounds a part of a periphery of the second suction device.

5. The lid forming device according to claim 3, wherein the first suction device is configured to selectively switch a timing for when the first suction device releases the first face after sucking the first face, and the second suction device is configured to selectively switch a timing for when the second suction device releases the second face after sucking the second face.

6. The lid forming device according to claim 1, wherein the second folding mechanism is configured to perform a first operation to insert into the slit a predetermined portion of the first face of the second flap that has been bent into a mountain shape and a second operation to extend the second flap after the first operation and further insert the predetermined portion that has been inserted into the slit toward a far side of the slit.

7. The lid forming device according to claim 6, wherein in the first operation the second folding mechanism forms a first insertion state in which the predetermined portion is inserted into the slit by a first dimension and thereafter forms a second insertion state in which the predetermined portion is inserted into the slit by a second dimension that is smaller than the first dimension.

8. The lid forming device according to claim 1, wherein the second folding mechanism further has a drive unit configured to drive the first retaining unit and the second retaining unit until the relative angle between the first face and the second face of the second flap becomes a predetermined angle.

9. The lid forming device according to claim 8, wherein the predetermined angle is set in a range of 90 to 120 degrees.

10. The lid forming device according to claim 1, further comprising:

a control unit configured to control the second folding mechanism; and a detection unit configured to detect, and output to the control unit, a height position of the second flap that has been folded by the second folding mechanism from a predetermined reference surface, wherein the control unit is further configured to cause the second folding mechanism to refold the second flap in a case where it is determined that the height position is not in a predetermined range.

11. A lid forming device that forms a lid of a cardboard box using, out of a group of flaps having a cantilever structure and provided on edges of an opening of the cardboard box, a first flap in which a slit is formed and a second flap to be extended after being bent into a mountain shape, the lid forming device comprising:

a first folding mechanism configured to fold the first flap in a direction in which the first flap closes the opening;

a second folding mechanism configured to bend the second flap into a mountain shape and insert part of the second flap into the slit of the first flap while extending the second flap, wherein the second folding mechanism includes a first retaining unit configured to retain a first face of the second flap located between a free end of the second flap and a bend line set beforehand in the second flap and a second retaining unit configured to retain a second face of the second flap located between an anchored end of the second flap and the bend line; and the lid forming device further includes a control unit configured to control the second folding mechanism, wherein the second folding mechanism further includes a first drive unit configured to cause the second flap to pivot about the anchored end of the second face, a second drive unit configured to retain and release the first face and the second face of the second flap using the first retaining unit and the second retaining unit, a third drive unit configured to drive the first retaining unit and the second retaining unit until the relative angle between the first face and the second face of the second flap becomes a predetermined angle, and a measuring unit configured to measure, and output to the control unit, at least an operating time of the third drive unit, and the control unit is further configured to adjust an operation of the first drive unit and/or an operation of the second drive unit based on the operating time of the third drive unit.

12. The lid forming device according to claim 11, wherein the first drive unit is a servo motor and the third drive unit is an air cylinder.

* * * * *